US006846213B2

(12) United States Patent
Sato

(10) Patent No.: US 6,846,213 B2
(45) Date of Patent: Jan. 25, 2005

(54) ELECTRON SOURCE, IMAGE DISPLAY DEVICE MANUFACTURING APPARATUS AND METHOD, AND SUBSTRATE PROCESSING APPARATUS AND METHOD

(75) Inventor: Yasue Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 464 days.

(21) Appl. No.: 09/797,568

(22) Filed: Mar. 5, 2001

(65) Prior Publication Data

US 2001/0039161 A1 Nov. 8, 2001

(30) Foreign Application Priority Data

Mar. 6, 2000 (JP) ..... 2000-061130
Feb. 26, 2001 (JP) ..... 2001-050976

(51) Int. Cl.[7] ..... H01J 9/44
(52) U.S. Cl. ..... 445/6; 445/24
(58) Field of Search ..... 445/6, 24, 25; 438/34

(56) References Cited

U.S. PATENT DOCUMENTS

| | | | | |
|---|---|---|---|---|
| 4,969,168 | A | 11/1990 | Sakamoto et al. | 378/34 |
| 5,622,634 | A | 4/1997 | Noma et al. | 216/40 |
| 5,792,304 | A | 8/1998 | Tamura et al. | 156/345 |
| 5,906,684 | A | 5/1999 | Tamura et al. | 118/728 |
| 5,961,774 | A | 10/1999 | Tamura et al. | 156/345 |
| 5,985,035 | A | 11/1999 | Tamura et al. | 118/724 |
| 6,048,434 | A | 4/2000 | Tamura et al. | 156/345 |
| 6,129,046 | A | 10/2000 | Mizuno et al. | 118/725 |
| 6,169,356 | B1 | 1/2001 | Ohnishi et al. | 313/495 |
| 6,217,705 | B1 | 4/2001 | Tamura et al. | 156/345 |
| 6,221,201 | B1 | 4/2001 | Tamura et al. | 156/345 |
| 6,336,991 | B1 | 1/2002 | Tamura et al. | 156/345 |
| 6,582,268 | B1 * | 6/2003 | Jindai et al. | 445/6 |
| 2001/0009178 | A1 | 7/2001 | Tamura et al. | 156/345 |
| 2001/0025608 | A1 | 10/2001 | Tamura et al. | 118/728 |
| 2001/0036682 | A1 | 11/2001 | Takeda et al. | 438/34 |
| 2002/0046706 | A1 | 4/2002 | Tamura et al. | 118/728 |
| 2002/0096116 | A1 | 7/2002 | Tamura et al. | 118/728 |
| 2002/0104618 | A1 | 8/2002 | Tamura et al. | 156/345.51 |
| 2002/0108574 | A1 | 8/2002 | Tamura et al. | 118/728 |

FOREIGN PATENT DOCUMENTS

| | | | |
|---|---|---|---|
| EP | 0 908 916 A1 | 4/1999 | |
| JP | 57/161241 | 10/1982 | |
| JP | 60-013740 | 1/1985 | H01L/21/68 |
| JP | 07-086382 | 3/1995 | H01L/21/68 |
| JP | 7-235255 | 9/1995 | |
| JP | 07-263528 | 10/1995 | H01L/21/68 |
| JP | 08064119 A | 3/1996 | H01J/9/02 |
| JP | 8-171849 | 7/1996 | |
| JP | 09-256153 | 9/1997 | C23C/14/50 |
| JP | 09/330653 | 12/1997 | H01J/9/02 |
| JP | 2748127 | 2/1998 | H01L/21/027 |
| JP | 10/206876 A | 8/1998 | G02F/1/1345 |
| JP | 10-255644 A | 9/1998 | H01J/1/30 |
| JP | 2866312 | 12/1998 | H01J/9/02 |
| JP | 11-195374 | 7/1999 | |
| JP | 11-312461 | 11/1999 | |
| JP | 2000-311594 | 11/2000 | |
| JP | 3320387 | 6/2002 | H01J/9/02 |
| KR | 95-10014 | 4/1995 | H01L/21/68 |

* cited by examiner

*Primary Examiner*—Joseph Williams
(74) *Attorney, Agent, or Firm*—Fitzpatrick, Cella, Harper & Scinto

(57) ABSTRACT

An electron source/image display device manufacturing apparatus according to this invention includes (A) a support which supports a substrate having a first major surface and a second major surface on which a conductor is arranged, and includes a plurality of electrostatic chucks each having a conductive member, (B) a vessel which has a gas inlet port and an exhaust port, and covers part of the first major surface, (C) a valve connected to the inlet port to introduce gas into the vessel, (D) an exhaust system connected to the exhaust port to exhaust the gas from the vessel, and (E) a power supply for applying a predetermined potential difference between the conductor and the conductive member. This apparatus arrangement enables easy, stable processing in the "forming" and "activation" steps.

29 Claims, 8 Drawing Sheets

ELECTRON SOURCE, IMAGE DISPLAY DEVICE MANUFACTURING APPARATUS AND METHOD, AND SUBSTRATE PROCESSING APPARATUS AND METHOD

FIELD OF THE INVENTION

The present invention relates to an electron source, an image display device manufacturing apparatus and method, and a substrate processing apparatus and method for executing steps of forming a film on a substrate.

BACKGROUND OF THE INVENTION

A plasma display, EL display device, and image display device using an electron beam are known as emissive type image display devices. In recent years, demands are arising for larger-screen, higher-resolution image display devices, and needs for emissive type image display devices are increasing.

For example, as an emissive type image display device using an electron beam, the present applicant has applied a thin image display device in which an electron source for generating an electron beam is arranged in an envelope that is made up of a face plate, rear plate, and outer frame and can maintain vacuum, surface-conduction type electron-emitting devices are arrayed in a matrix as the electron source, an electron beam emitted by the electron source is accelerated to irradiate a fluorescent substance applied to the face plate, and the fluorescent substance emits light to display an image (e.g., Japanese Patent Laid-Open Nos. 7-235255, 11-312461, 8-171849, 2000-311594, and 11-195374, EP-A-0908916).

The surface-conduction type electron-emitting device is constituted by forming on a substrate a pair of opposing electrodes, and a conductive film which is connected to the pair of electrodes and partially has a gap. A carbon film mainly consisting of at least one of carbon and a carbon compound is formed at the gap.

Such electron-emitting devices can be arrayed on a substrate and wired to each other to fabricate an electron source having a plurality of surface-conduction type electron-emitting devices.

This electron source can be combined with a fluorescent substance to form an image display device.

The electron source and image display device are manufactured as follows.

As the first manufacturing method, a plurality of units each made up of a conductive film and a pair of electrodes connected to the conductive film, and wires connected to the electrodes of the respective units are formed on a substrate. The resultant substrate is set in a vacuum chamber. After the vacuum chamber is evacuated, a voltage is applied to each unit to form a gap in the conductive film of the unit ("forming" step). A carbon compound gas is introduced into the vacuum chamber, and a voltage is applied to each unit via an external terminal in this atmosphere. By voltage application, a carbon film mainly consisting of at least one of carbon and a carbon compound is formed near the gap ("activation" step). As a result, each unit is changed into an electron-emitting device, and an electron source made up of a plurality of electron-emitting devices is obtained. After that, the substrate having the electron source, and a substrate having a fluorescent substance are joined at an interval of several mm to fabricate the panel of an image display device.

As the second manufacturing method, a plurality of units each made up of a conductive film and a pair of electrodes connected to the conductive film, and wires connected to the electrodes of the respective units are formed on a substrate. The resultant substrate, and a substrate having a fluorescent substance are joined at a small interval of several mm to fabricate the panel of an image display device. The interior of the panel is evacuated via an exhaust pipe connected to the panel, and a voltage is applied to each unit via the external terminal of the panel to form a gap in the conductive film of the unit ("forming" step). A carbon compound gas is introduced into the panel via the exhaust pipe, and a voltage is applied again to each unit via the external terminal in this atmosphere. By voltage application, a carbon film mainly consisting of at least one of carbon and a carbon compound is formed near the gap ("activation" step). Thus, each unit is changed into an electron-emitting device, and an electron source made up of a plurality of electron-emitting devices is attained.

As the first manufacturing method, a method disclosed in Japanese Patent Laid-Open No. 11-312461 will be explained.

FIG. 8 is a schematic view showing an image display device manufacturing apparatus described in this reference.

In FIG. 8, reference numeral 71 denotes a glass substrate on which a plurality of units and wires connected to the units are formed; 133, an vacuum chamber; 134, a gate valve; 135, an exhaust device; 136, a pressure gauge; 137, Q-mass as a quadruple-pole mass spectrometer; 138, a gas inlet line; 139, a gas inlet controller constituted by a solenoid valve, mass-flow controller, or the like; and 140, a supply substance source.

A plurality of units each made up of a pair of electrodes and a conductive thin film are formed on the substrate 71, and matrix wires to be connected to the units are formed (not shown).

The pair of electrodes are formed as follows. A conductive material such as a metal (Pt, Au, or the like) is formed into a film by sputtering or vapor deposition. The photolithography step including resist coating, exposure and-developing of an electrode pattern, plasma etching, and plasma ashing is performed to form electrodes.

The substrate 71 is set in the vacuum chamber 133 of the manufacturing apparatus shown in FIG. 8, and the matrix wires are electrically connected to a voltage application means outside the vacuum chamber. After the interior of the vacuum chamber 133 is evacuated, a voltage pulse is applied to each unit via the matrix wires to perform the above-mentioned "forming step".

After the interior of the vacuum chamber 133 is sufficiently evacuated, an organic substance is supplied from the supply substance source 140 into the vacuum chamber 133 while the pressure gauge 136 and Q-mass 137 are monitored to set a desired pressure and partial pressure. Similar to the "forming" step, a voltage pulse is applied to each unit to execute the above-described "activation" step, which changes each unit into an electron-emitting device. After the "activation" step, the substrate 71 is unloaded from the vacuum chamber 133. The obtained substrate 71 serves as an electron source substrate.

The electron source substrate, a face plate having a fluorescent substance on its inner surface, and a support frame having an exhaust pipe formed from a glass pipe and getters mainly consisting of Ba are temporarily fixed via frit glass so as to oppose each other. The structure is baked in a heating furnace in an inert gas atmosphere to fabricate an airtight envelope.

An exhaust pipe is connected to the exhaust device 135 to evacuate the interior of the envelope. The exhaust pipe is chipped off by a burner or the like. The getters are flashed by RF heating to form a Ba film, and the vacuum in the envelope after chipping-off is maintained. In this fashion, an image display device formed from an envelope is fabricated.

SUMMARY OF THE INVENTION

The first manufacturing method, however, requires a larger vacuum chamber and a high-vacuum compatible exhaust device as the electron source substrate becomes larger. The second manufacturing method requires a long time in uniformly introducing gas into a narrow space inside the panel that is used in the "forming" and "activation" steps and exhausting the gas from the panel.

The first aspect of the present invention has been made to overcome the conventional drawbacks, and has as its object to provide an electron source manufacturing apparatus and method, and image display device manufacturing apparatus and method that can shorten the time particularly for the "activation" step, can improve the uniformity of electron-emitting characteristics, and are suitable for mass production.

According to the first aspect of the present invention, a method of manufacturing an electron source and image display device comprises the steps of (A) preparing a substrate on which a plurality of units each formed from a pair of electrodes and a conductive film interposed between the electrodes, and wires connected to the units are arrayed on a first major surface, and a conductor is arranged on a second major surface opposing the first major surface, (B) preparing a support including a plurality of fixing means each having a conductive member, (C) fixing the substrate to the support by applying a potential difference between the conductive member and the conductor, (D) arranging the plurality of units in a space defined by the substrate and a vessel by covering part of the first major surface of the substrate with the vessel, and arranging part of the wires outside the space, and (E) setting a desired atmosphere in the space while applying a voltage to the plurality of units via part of the wires.

According to the first aspect of the present invention, an apparatus for manufacturing an electron source and image display device comprises (A) a support which supports a substrate having a first major surface and a second major surface on which a conductor is arranged, and includes a plurality of fixing means each having a conductive member, (B) a vessel which has a gas inlet port and an exhaust port, and covers part of the first major surface, (C) introducing means, connected to the inlet port, for introducing gas into the vessel, (D) exhaust means, connected to the exhaust port, for exhausting the gas from the vessel, and (E) means for applying a predetermined potential difference between the conductor and the conductive member.

In the "forming" and "activation" steps, Joule heat is generated on the surface of the substrate 71 by a current flowing through the wire, and heats the substrate surface. If the number of units subjected to the "forming" and "activation" steps increases, the temperature of the substrate 71 may excessively rise to deform the substrate 71. If the substrate 71 greatly deforms, the voltage application means and a wire connected to each unit may be insufficiently electrically connected, resulting in unstable "forming" and "activation" steps. Furthermore, if the temperature difference on the substrate surface increases, the substrate 71 may be damaged.

Sometimes, the "forming" and "activation" steps cannot be uniformly performed owing to the temperature distribution caused by an increase in substrate size. Characteristics may become nonuniform between electron-emitting devices, failing to obtain an electron source and image display device with high uniformity.

In the conventional method described with reference to FIG. 8, plasma etching and plasma ashing are done in the photolithography step of patterning a pair of electrodes constituting each unit. To perform plasma etching and plasma ashing at a higher speed, the resist is excessively heated, carbonized too much, and cannot be removed. This problem is not unique to patterning of the electrode of the electron-emitting device, but occurs when the conductive film is patterned using plasma etching, plasma ashing, and the like.

As the substrate size increases, a local temperature distribution becomes prominent in plasma etching and plasma ashing. In some cases, the characteristics of the resist partially change, and the resist etching rate changes. In the etching step in which satisfactory selectivity cannot be ensured, the margin of the etching time decreases. The changes in resist characteristics lead to a nonuniform ashing rate, and part of the resist cannot be sufficiently removed. Resultantly, the conductive film cannot be patterned with high precision.

The second aspect of the present invention has been made to overcome the conventional drawbacks caused by heat (or temperature distribution) generated on a substrate, and has as its object to provide an electron source/image display device manufacturing apparatus, electron source/image display device manufacturing method, and substrate processing apparatus and method that can keep the substrate temperature with high uniformity, thereby ① suppressing the thermal distribution on a substrate in the "forming" and "activation" steps, and ② ensuring the margin of the etching time and patterning a conductive film with high uniformity.

According to the second aspect of the present invention, an electron source/image display device manufacturing apparatus comprises (A) a vessel which has a pressure-reducible space, a gas inlet port for introducing gas into the space, and an exhaust port for exhausting the gas from the space, (B) a support which supports a substrate having a first major surface and a second major surface on which a conductor is arranged, includes a temperature control means and a plurality of fixing means each having a conductive member, and is arranged in the space, (C) introducing means, connected to the inlet port, for introducing gas into the vessel, (D) exhaust means, connected to the exhaust port, for exhausting the gas from the vessel, and (E) means for applying a predetermined potential difference between the conductor and the conductive member.

According to the second aspect of the present invention, an electron source/image display device manufacturing method comprises the steps of (A) preparing a vessel which has a pressure-reducible space, a gas inlet port for introducing gas into the space, and an exhaust port for exhausting the gas from the space, (B) preparing in the space a support including a temperature control means and a plurality of fixing means each having a conductive member, (C) preparing a substrate on which a plurality of units each formed from a pair of electrodes and a conductive film interposed between the electrodes, and wires connected to the units are arrayed on a first major surface, and a conductor is arranged on a second major surface opposing the first major surface, (D) loading the substrate into the space, (E) fixing the substrate to the support in the space by applying a potential difference between the conductive member and the conductor, and (F) setting a desired atmosphere in the space, and applying a voltage to the plurality of units via the wires while controlling a temperature of the substrate by the temperature control means.

According to the second aspect of the present invention, a substrate processing apparatus comprises (A) a support which supports a substrate having a conductor, and includes a temperature control means and a plurality of fixing means each having a conductive member, and (B) means for applying a potential difference between the conductor and the conductive member.

According to the second aspect of the present invention, a substrate processing method comprises the steps of (A) preparing a support including a temperature control means and a plurality of fixing means each having a conductive member, (B) preparing a substrate having a conductor, (C) fixing the substrate to the support by applying a potential difference between the conductive member and the conductor, and (D) performing predetermined processing for a surface of the substrate while controlling a temperature of the substrate by the temperature control means.

According to the first aspect of the present invention, the power supply and wires can be easily electrically connected in air in electrical processing ("forming" and "activation"). Since the degree of freedom of the design such as the size and shape of the vessel increases, gas can be introduced/exhausted into/from the vessel within a short time, and the manufacturing speed increases. Also, the reproducibility and uniformity of the electron-emitting characteristics of a manufactured electron source can be improved. Even an image display device using this electron source can obtain a display image with high uniformity.

According to the first and second aspects of the present invention, the substrate is fixed to the support by an electrostatic force generated between the conductive member arranged in the fixing means fixed to the support and the conductor arranged on the substrate. Even if the substrate flatness decreases in the use of a large area substrate, the fixing means (electrostatic chuck) is made up of a plurality of fixing means, and adhesion properties between each fixing means (electrostatic chuck) and the substrate surface can be improved in comparison with a single plate-like fixing means (electrostatic chuck). Since the degree of contact between each fixing means (electrostatic chuck) and a substrate to be processed increases, thermal contact between the substrate and the fixing means (electrostatic chuck) is improved, and the substrate temperature can be satisfactorily controlled. Therefore, the present invention can suppress the carbonization of the resist.

In the manufacturing apparatus and method and the processing apparatus and method according to the first and second aspects of the present invention, an independent temperature control means is preferably adopted for "each fixing means" (electrostatic chuck) because this further increases the uniformity. This arrangement reduces the above-mentioned changes in resist etching rate depending on the location. Even in the etching step in which the selectivity cannot be ensured, the margin of the etching time can be preferably increased. Furthermore, the uniformity of the ashing rate is also improved to solve the problem that the resist cannot be removed.

As the substrate size increases, the difference in thermal expansion between the fixing means (electrostatic chuck) and the support which fixes the fixing means (electrostatic chuck) increases in the use of only a single fixing means (electrostatic chuck). A ceramic fixing means (electrostatic chuck) may be damaged. However, if the fixing means is divided into a plurality of fixing means (electrostatic chucks), like the present invention, the difference in thermal expansion can be decreased to decrease the internal stress of the fixing means (electrostatic chuck) and suppress damage.

In the case wherein the fixing means is divided into a plurality of fixing means (electrostatic chucks), like the present invention, even if the surface of a fixing means (electrostatic chuck) at a given portion is damaged or a fixing means (electrostatic chuck) is broken, only the damaged fixing means (electrostatic chuck) can be exchanged, which decreases the cost of the manufacturing apparatus.

The present invention can efficiently control Joule heat generated on the substrate surface owing to a current flowing through the wires in the "forming" and "activation" steps. Even if the number of units to be processed increases, the temperature rise of the substrate can be suppressed, deformation of the substrate by heat can be suppressed, an electrical signal can be properly supplied, and damage to the substrate can be prevented. Hence, defectives can be reduced, the yield can be increased, and the process can be safely advanced. Even if the substrate size increases, the temperature of a substrate to be processed can be controlled to a desired temperature by executing independent temperature control for each fixing means (electrostatic chuck). Since temperature control can be done with high uniformity on the substrate, surface-conduction type electron-emitting devices can be formed with high uniformity. This can improve the performance of the electron source and image display device.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

The present invention will be described in detail below with reference to the accompanying drawings.

(Embodiment of First Aspect of Present Invention)

The embodiment of the first aspect of the present invention will be described.

Figure 1:
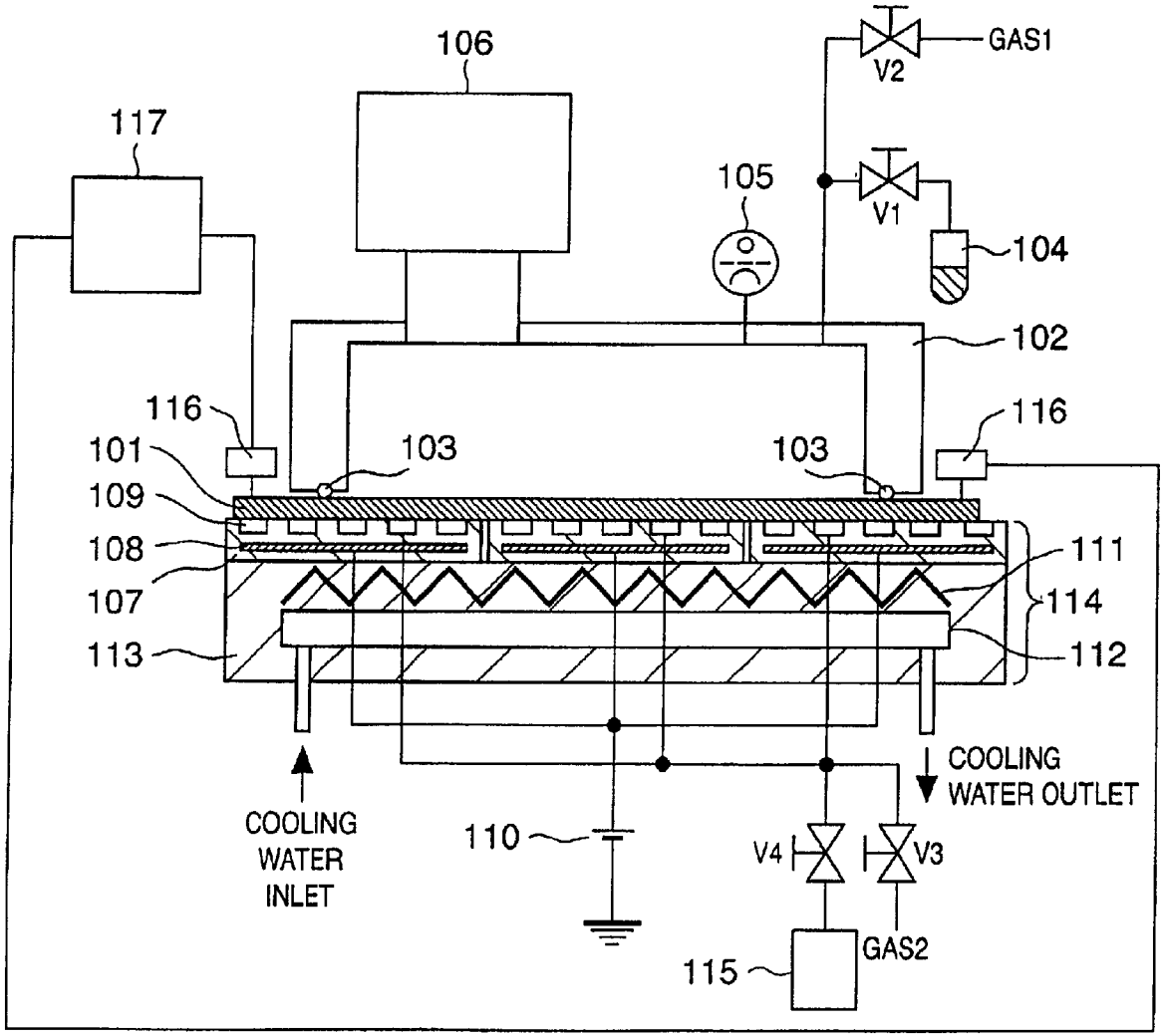
FIG. 1 is a block diagram showing an image display device manufacturing apparatus according to the first aspect of the present invention.

FIG. 1 is a block diagram showing an example of an image display device/electron source manufacturing apparatus according to the embodiment of the first aspect of the present invention.

Figure 3:
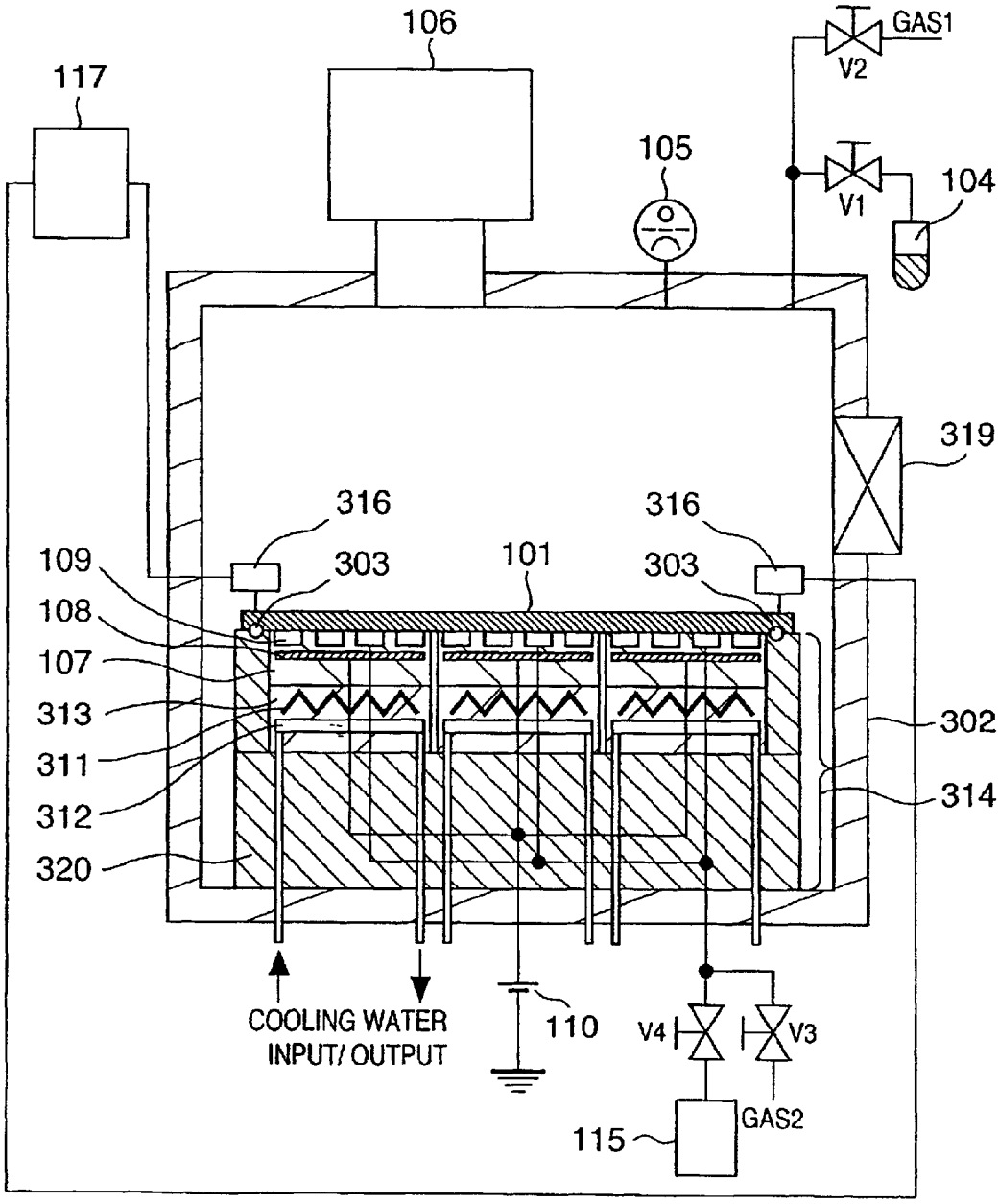
FIG. 3 is a block diagram showing a manufacturing apparatus according to the second aspect of the present invention in which an entire substrate is set in vacuum.

In FIG. 1, reference numeral 101 denotes a device formation substrate (to be simply referred to as a substrate); 102, a vessel; 103, a sealing member such as an O-ring which airtightly joins the vessel 102 and substrate 101; 104, a substance to be supplied into the vessel 102. The substance 104 is a carbon compound when this apparatus is used in the "activation" step. The substrate 104 is not necessarily used when the apparatus is used in the "forming" step. However, when the apparatus is used in the "forming" step, the substrate 104 is preferably a reducing substance for a conductive film which forms a unit. The reducing substance is preferably hydrogen when the conductive film forming the unit is made of an oxide such as Pdo. Reference numeral 105 denotes an ionization vacuum gauge as a vacuum gauge; 106, an evacuation system; 107, a plurality of fixing members (to be referred to as "electrostatic chucks" hereinafter); 108, a conductive member (electrode) buried in each electrostatic chuck 107; and 109, a groove formed in the surface of each electrostatic chuck 107. The groove 109 is not always necessary, but is preferably used when one electrostatic chuck 107 is large, or gas is used as a heat conductor between the surface of the electrostatic chuck 107 and the substrate 101 (to be described in detail later). Reference numeral 110 denotes a voltage source for applying a DC voltage to the conductive member 108; 111, a heating unit; 112, a cooling unit; and 113, a temperature control means on which the heating unit 111 and cooling unit 112 are mounted. The temperature control means 113 is not always necessary in this embodiment, but is preferably used when the substrate 101 is large. In this embodiment, the temperature control means 113 is constituted by a single temperature control means, but the temperature control means 113 may be constituted by a plurality of temperature control means 313, as shown in FIG. 3. When the temperature control means is constituted by a plurality of temperature control means, it is preferable that the temperature control means be equal in number to the electrostatic chucks 107, and one temperature control means and one electrostatic chuck constitute one unit. Reference numeral 114 denotes a support including the temperature control means 113 and the electrostatic chucks 107 mounted on the temperature control means 113 in FIG. 1; 115, a chucking exhaust system; 116, a connection means (terminal); and 117, a signal generator. Reference symbols V1 to V4 denote valves. Note that the vessel 102 is vertically movable with respect to the support 114.

In this arrangement, the substrate 101 has first and second major surfaces. The substrate 101 is mainly made from a glass substrate, and a conductor is arranged as an electrode on the second major surface in order to generate an electrostatic force by the electrostatic chuck 107. The conductor on the second major surface of the substrate 101 is preferably a film. Examples of the material of the conductor are a metal, semiconductor, and metal oxide. The resistivity of the conductor is preferably $1\times10^{9}$ [Ωcm] or less. A plurality of units each made up of a pair of electrodes and a conductive film connecting the electrodes, and a plurality of wires respectively connected to the units are formed on the first major surface of the substrate 101.

This embodiment exemplifies the temperature control means 113 which incorporates the heating unit 111 and cooling unit 112 for controlling the temperature. The most convenient heating unit 111 is an electric heater, but a high-temperature medium may be introduced. The heating means is not limited to a specific one as far as it can heat. The cooling unit 112 preferably uses water as a coolant, but cooling by a Peltier element is also possible. The cooling means is not limited to a specific one so long as it can cool. Alternatively, the same medium may be used as the high-temperature medium and coolant, and cooling and heating may be done by a single means. The heating unit 111 and cooling unit 112 can be controlled by the controller of a computer or the like, thereby controlling the temperature of the temperature control means 113 to a desired value.

In the apparatus described in this embodiment, a plurality of electrostatic chucks 107 are mounted on the temperature control means 113. In general, if a thin film is formed on the surface of a glass substrate, unique "warpage" determined by the material and process conditions is generated owing to the difference in residual stress and thermal expansion coefficient. In many cases, "undulation" (short-cycle wavy surface) exists on the glass substrate upon formation. If the substrate 101 "warps" or "undulates", the electrostatic chucking force of the electrostatic chuck 107 decreases, and an excessively warping substrate 101 cannot be chucked. This warpage increases as the area of the substrate 101 increases. This aspect, therefore, adopts a plurality of electrostatic chucks 107 to keep a small interval between the substrate 101 and the surface of each electrostatic chuck 107.

Figure 2:
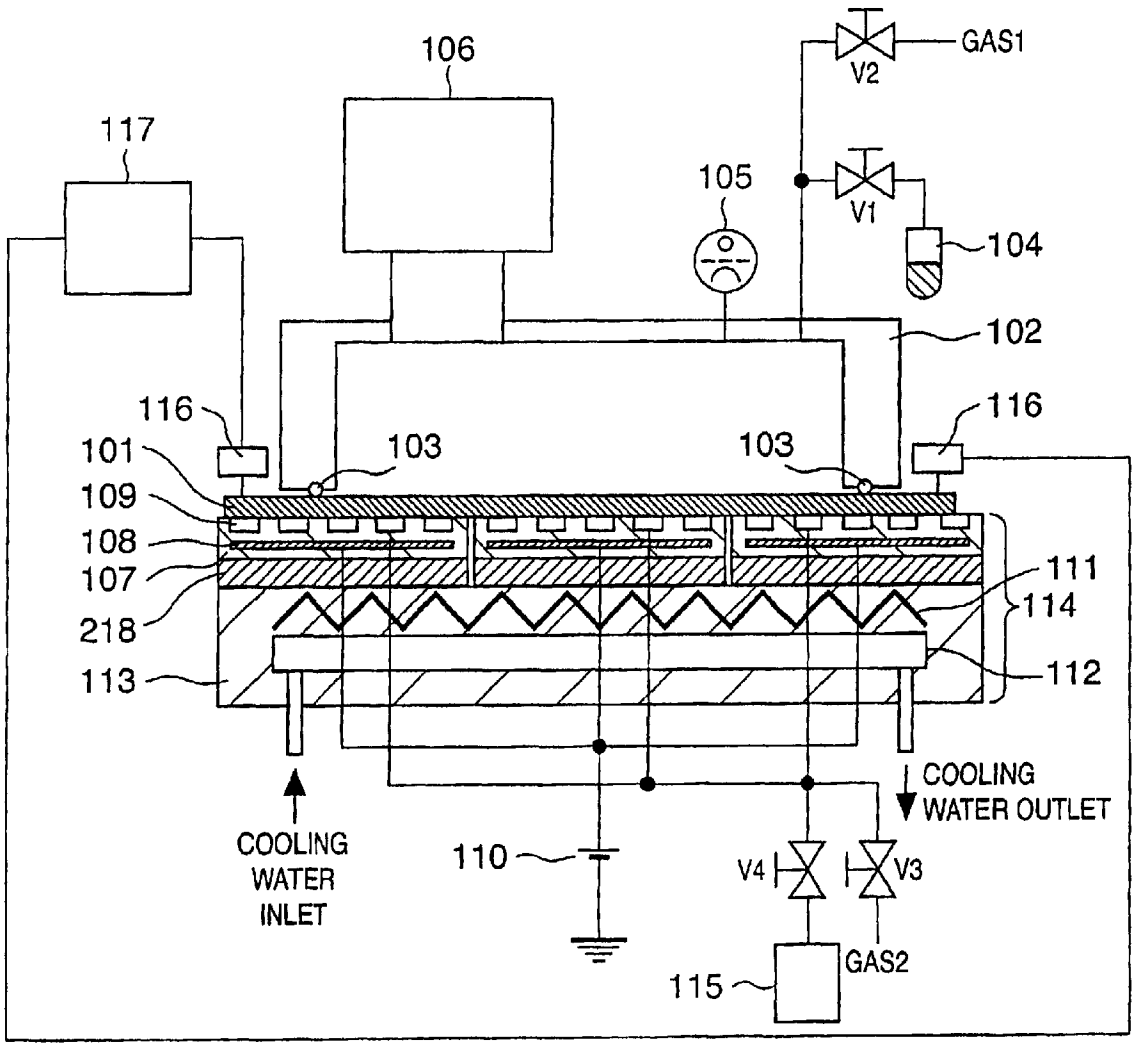
FIG. 2 is a block diagram showing a manufacturing apparatus which comprises a position adjusting mechanism according to the first aspect of the present invention.

FIG. 2 is a block diagram showing an example in which position adjusting mechanisms 218 are added below the respective electrostatic chucks 107 in FIG. 1. The same reference numerals as in FIG. 1 denote the same parts, and a description thereof will be omitted. FIG. 2 shows the position adjusting mechanisms 218.

In the arrangement of FIG. 2, each position adjusting mechanism 218 is arranged below a corresponding electrostatic chuck 107 to adjust the interval between the electrostatic chuck 107 and the substrate 101 so as to keep the interval between the substrate 101 and the surface of the electrostatic chuck 107 smaller than in the apparatus of FIG. 1. The position adjusting mechanism 218 can improve attraction properties between the substrate 101 and the electrostatic chuck 107, and can maintain good thermal contact between the substrate 101 and the electrostatic chuck 107.

To improve thermal contact between the substrate 101 and the electrostatic chuck 107, it is effective that the groove 109 is formed in the surface of the electrostatic chuck 107, and gas (gas 2) is introduced into this groove (between the substrate 101 and the surface of the electrostatic chuck 107). Microscopically, the substrate 101 and electrostatic chuck 107 are in point contact with each other, and no gas exists between them. At a temperature of 200° C. or less, the substrate 101 and electrostatic chuck 107 thermally contact each other by only thermal conduction through point-contact portions, and heat is difficult to transfer. To the contrary, if gas 2 is introduced between the substrate 101 and the electrostatic chuck 107, as described above, the substrate 101 and electrostatic chuck 107 thermally contact each other by convection, which improves thermal contact. The experimental results show that the satisfactory effects were obtained when the pressure of gas 2 was 500 Pa or more. To hold vacuum, an airtight member (sealing member) such as an O-ring may be interposed between the electrostatic chuck 107 and the substrate 101. The type of gas 2 is not especially limited, but is preferably a gas which has a high thermal conduction coefficient, is safe, hardly influences the environment, and can be easily treated. Helium meets these conditions.

Gas 2 is introduced by forming a gas inlet path in the electrostatic chuck 107 in FIG. 1, but may be introduced through the groove 109 formed in the surface of the electrostatic chuck 107. In this case, since no hole need be formed in the electrostatic chuck 107, a conductive member (electrode) can be arranged in a large area on the entire surface, and a decrease in the chucking force of the electrostatic chuck 107 can be suppressed. Also, the manufacturing process of the electrostatic chuck 107 can be simplified to decrease the manufacturing cost.

When the temperature control means 113 is employed in FIGS. 1 and 2, the temperature control means 113 and electrostatic chuck 107 preferably have the same thermal expansion coefficient. This suppresses a stress generated inside the temperature control means 113 and electrostatic chuck 107 due to the difference in thermal expansion coefficient as the temperatures of the temperature control means 113 and electrostatic chuck 107 rise. When the temperature control means 113 is made of a metal or a metal-containing composite material, and the electrostatic chuck 107 is made of a ceramic, the allowable stress of the ceramic is small, so the electrostatic chuck 107 may be damaged. Note that the electrostatic chuck 107 was experimentally confirmed not to be damaged when the size of the electrostatic chuck 107 is almost 0.1 $m^2$ or less, and the difference in thermal expansion coefficient between the temperature control means 113 and the electrostatic chuck 107 is within 30%. Hence, the difference in thermal expansion coefficient between the temperature control means 113 and the electrostatic chuck 107 is preferably set within 30%.

All the units are arranged in a space defined by the vessel 102 and the first major surface of the substrate 101. Part of each wire formed on the substrate 101 so as to be connected to a corresponding unit is exposed on the first major surface outside the space. The exposed part of the wire is electrically connected to the connection means (terminal) 116. A desired electrical signal (potential) generated by the signal generator (power supply) 117 is supplied via the connection means 116 to a pair of electrodes constituting each unit. The connection means (terminal) 116 is a probe pin, flexible cable, or the like, but is not limited to such means so far as the connection means (terminal) 116 can electrically contact the wire.

An example of a method of manufacturing an electron source and image display device according to the present invention by using the image display device manufacturing apparatus shown in FIG. 1 will be described.

While the vessel 102 and support 114 are fully apart from each other, the substrate 101 is set on the support 114. The valve V3 is closed, and the valve V4 is opened. The chucking exhaust system 115 evacuates the interior of each groove 109 to 100 Pa or less to chuck the substrate 101 to the surface of each electrostatic chuck 107. At this time, the conductor on the second major surface of the substrate 101 is electrically grounded.

The power supply 110 applies a potential difference of 100 V or more to 10 kV or less, preferably 500 V or more to 2 kV or less between the conductor and each electrode 108. This generates an electrostatic force between the electrode (conductive member) and the second major surface (conductor) of the substrate 101 to fix the substrate 101 to the support 114. Then, the valve V4 is closed, and the valve V3 is opened. Gas 2 such as He gas is supplied, and the internal pressure of the groove 109 is kept at a pressure at which the substrate 101 is not detached.

The vessel 102 is moved toward the support 114, and airtightly joined to the first major surface of the substrate 101 via the O-ring 103 serving as the sealing member. At this time, the vessel 102 covers part of the first major surface of the substrate 101, and all the units are enclosed in a space defined by the vessel 102 and the first major surface. However, part (end) of each wire connected to a corresponding unit is not arranged inside the space defined by the vessel 102 and the first major surface. That is, part (end) of the wire connected to the unit is exposed in air.

The main evacuation system 106 evacuates the airtight space defined by the first major surface of the substrate 101 and the vessel 102 to a desired atmosphere (e.g., pressure of $1\times10^{-4}$ Pa or less).

If necessary, the temperature control means 113 controls the temperature of the substrate 101 to a desired temperature with high uniformity by flowing cooling water through the cooling unit 112 and/or heating the substrate 101 by the heating unit 111.

After that, the "forming" step is performed. In the "forming" step, the connection means (terminal) 116 is electrically connected to part (end) of each wire exposed in air, and the signal generator (power supply) 117 applies a voltage necessary for the "forming" step to each unit. A current flows through a conductive film forming the unit to form a gap in part of the conductive film.

When the conductive film forming each unit is made of a conductive oxide, the "forming" step is preferably executed by opening the valve V2 in the "forming" step and introducing a reducing gas, e.g., hydrogen-containing gas as gas 1 into the space in order to decrease power necessary for "forming". With the use of the temperature control means 113, as described above, it can efficiently control via the electrostatic chuck 107 heat generated by a current flowing through the wire connected to the unit in the "forming" step. Thus, the substrate 101 is kept at a desired temperature with high uniformity, and appropriate "forming" can be done.

The valve V2 is closed, and the evacuation system 106 evacuates the space defined by the substrate 101 and the vessel 102 to a pressure of $1\times10^{-4}$ Pa or less.

Then, the "activation" step is performed. When the temperature control means 113 is used, it controls the temperature of the substrate 101 to a temperature (from room temperature to about 120° C.) suitable for "activation". The valve V1 is opened to introduce a carbon compound gas into the space defined by the vessel 102 and the substrate 101. If necessary, the gas is introduced while the ionization vacuum gauge 105 measures the pressure. The pressure of the introduced carbon compound gas is preferably $1\times10^{-3}$ to $1\times10^{-5}$ Pa depending on the introduced carbon compound. The carbon compound is an organic such as benzonitrile, tolunitrile, or acetone. When the pressure in the space reaches a desired pressure, the "activation" step is executed similarly to the "forming" step. More specifically, the connection means (terminal) 116 is electrically connected to part (end) of each wire exposed in air (out of the space), and the signal generator (power supply) 117 applies a voltage necessary for the "activation" step to each unit. By this "activation" step, a carbon film is formed at the gap formed by the "forming" step, and each unit serves as an electron-emitting device. With the use of the temperature control means 113, it can efficiently control heat generated by a current flowing through the wire in the "activation" step, as in the "forming" step. The first major surface of the substrate 101 is kept at a desired temperature with high uniformity, and electron-emitting devices having excellent characteristics can be formed with high uniformity.

By these steps, an electron source having a plurality of electron-emitting devices and wires connected to the electron-emitting devices is fabricated.

In this embodiment, the "forming" and "activation" steps are performed by the same manufacturing apparatus, but may use dedicated apparatuses having the above arrangement.

Thereafter, a face plate having an inner surface coated with a fluorescent substance (phospher), a support frame having an exhaust pipe formed from a glass pipe and getters mainly consisting of Ba, and the substrate having the electron source are temporarily fixed via frit glass so as to oppose each other. The structure is baked in a heating furnace in an inert gas atmosphere at 400° C. to 480° C. to fabricate an airtight envelope.

The exhaust pipe formed from a glass pipe is connected to an oil-free evacuation device (pump). While the interior of the envelope is held at a temperature of 80° C. to 250° C., the interior of the envelope is evacuated. The exhaust pipe is chipped off by a burner or the like. The getters are flashed by RF heating to form a Ba film, and the vacuum in the envelope after chipping-off is maintained. Accordingly, an image display device is manufactured.

Embodiment of Second Aspect of Present Invention

FIG. 3 is a block diagram showing an example of an electron source/image display device manufacturing apparatus according to the second aspect of the present invention. In FIG. 3, the same reference numerals as in FIGS. 1 and 2 denote the same parts.

In FIG. 3, reference numeral 303 denotes an airtight member such as an O-ring; 302, a vessel which can be evacuated; 311, heating units; 312, cooling units; and 313, temperature control means which incorporate the heating and cooling units in this embodiment. The temperature control means 313 described in this embodiment are constituted by a plurality of independent temperature control means. In the second aspect of the present invention, however, the temperature control means need not always be constituted by a plurality of temperature control means, as shown in FIG. 3, but may be formed from a single temperature control means, as shown in FIG. 1 or 2. When a plurality of temperature control means are used, it is preferable that the temperature control means be equal in number to electrostatic chucks 107, and one temperature control means and one electrostatic chuck constitute one unit. Reference numeral 316 denotes a connection means (terminal) which can electrically contact a wire formed on the first major surface of a substrate 101 even in vacuum, and can supply a signal to the wire on the substrate 101; 319, a gate for loading the substrate 101 into the vessel 302; 320, a table for fixing the substrate 101; 314, a support comprised of the electrostatic chucks 107, temperature control means 313, and table 320 in this embodiment. The support 314 for fixing the substrate 101 is arranged in the vessel.

In the arrangement of FIG. 3, the gate 319 is opened to load the substrate 101 to the vessel (vacuum chamber) 302. A load lock chamber may be disposed on the opposite side via the gate 319 to load the substrate 101 to the vessel 302 in vacuum.

The respective electrostatic chucks 107 are fixed to the independent temperature control means 313. The temperature control means 313 are set on the table 320 so as to keep a small interval between the substrate 101 and the surfaces of the electrostatic chucks 107. If each temperature control means 313 has a dedicated controller (not shown), its heating unit 311 and cooling unit 312 can be controlled to reduce variations in the temperature distribution of the substrate 101 depending on the position. This is effective for a larger-area substrate 101.

In this embodiment, the airtight member 303 such as an O-ring is interposed between the periphery of the support 314 and the substrate 101 to hold vacuum between the substrate and the support 314. That is, the airtight member 303 can prevent gas 2 introduced between the second major surface of the substrate 101 and the electrostatic chuck 107 from leaking into the vessel 302 held in vacuum.

A method of manufacturing an electron source and image display device according to the second aspect of the present invention by using the electron source/image display device manufacturing apparatus shown in FIG. 3 according to the second aspect of the present invention will be described.

The gate 319 is opened, the substrate 101 is set on the support 314, and then the gate 319 is closed. A valve V3 is closed, and a valve V4 is opened. A chucking exhaust system 115 evacuates the interior of each groove 109 to 100 Pa or less to chuck the substrate 101 to the surface of each electrostatic chuck 107. At this time, a conductor on the second major surface of the substrate 101 is electrically grounded.

A power supply 110 applies a voltage of 100 V or more to 10 kV or less, preferably 500 V or more to 2 kV or less between ground and each electrode (conductive member) 108. This generates an electrostatic force between the electrode (conductive member) 108 and the second major surface (conductor) of the substrate 101 to fix the substrate 101 to the support 314. Then, the valve V4 is closed, and the valve V3 is opened. Gas 2 such as He gas is supplied, and the internal pressure of the groove 109 is kept at a pressure at which the substrate 101 is not detached.

Each temperature control means 313 controls the temperature of the substrate 101 to a desired temperature with high uniformity by flowing cooling water through the cooling unit 312 of the temperature control means 313 and/or heating the substrate 101 by the heating unit 311 thereof.

The connection means (terminal) 316 is electrically connected to the end of a wire connected to each unit.

A main evacuation system 106 evacuates the interior of the vessel 302 to a desired atmosphere (e.g., pressure of $1\times10^{-4}$ Pa or less).

The "forming" and "activation" steps are done similarly to the first aspect of the present invention.

In this case, the "forming" and "activation" steps are performed by the same manufacturing apparatus, but may use dedicated apparatuses having the above arrangement. It is also possible that these apparatuses are communicated with each other via a gate, and a series of steps are done in different chambers without exposure to air. After that, an image display device is manufactured similarly to the first aspect of the present invention.

Figure 4:
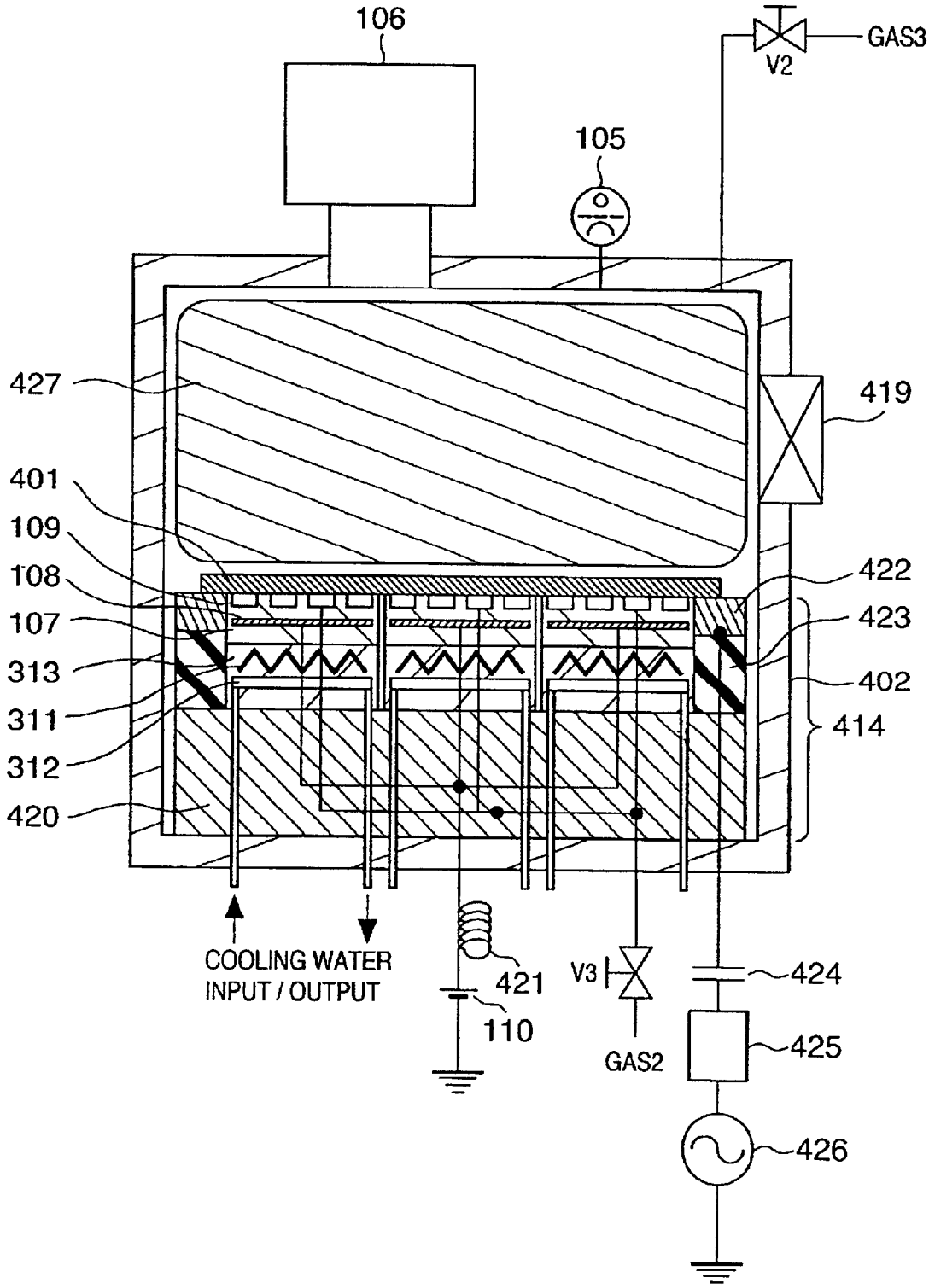
FIG. 4 is a block diagram showing a processing apparatus capable of executing RF plasma processing according to the second aspect of the present invention.

A substrate processing apparatus according to the second aspect of the present invention will be explained. FIG. 4 is a block diagram showing an arrangement of the substrate processing apparatus according to the second aspect of the present invention. In FIG. 4, the same reference numerals as in FIGS. 1, 2, and 3 denote the same parts.

In FIG. 4, reference numerals 107 denote electrostatic chucks; and 401, a substrate. The substrate 401 has first and second major surfaces, and a conductor is arranged on the second major surface. The conductor serves as an electrode for generating an electrostatic force between the substrate 401 and the electrode 108 incorporated in each electrostatic chuck 107. For this purpose, the conductor on the second major surface of the substrate 401 is preferably a film. Reference numeral 402 denotes a vessel; 419, a gate; 421, a filter for cutting an RF current; 422, an RF electrode; 423, an electrical insulator; and 420, a table which fixes a plurality of electrostatic chucks 107, temperature control means 313, and insulator 423. In this embodiment, the temperature control means 313 is divided into a plurality of parts. However, the temperature control means 113 need not always be constituted by a plurality of temperature control means, as shown in FIG. 4, but may be formed from a single temperature control means, as shown in FIG. 1 or 2. When a plurality of temperature control means are used, it is preferable that the temperature control means be equal in number to the electrostatic chucks 107, and one temperature control means and one electrostatic chuck constitute one unit. Reference numeral 414 denotes a support which comprises the RF electrode 422, the insulator 423, the plurality of electrostatic chucks 107, the plurality of temperature control means 313, and the table, and supports the substrate 401 in the vessel 402.

Reference numeral 424 denotes a capacitor for cutting a DC current to the RF electrode; 426, an RF power supply; 425, a matching box for minimizing reflection of RF power supplied from the RF power supply 426 and efficiently supplying the power to the RF electrode 422; and 427, a plasma.

The substrate processing apparatus shown in FIG. 4 can etch the substrate 401. A film to be etched is formed on the first major surface of the substrate 401 in advance by sputtering or vapor deposition, and a resist patterned into a desired pattern is formed on the film by photolithography. A conductor is arranged on the second major surface (surface in contact with the electrostatic chuck 107) of the substrate 401, similar to the second major surface of the substrate 101 described in the first aspect of the present invention.

In this embodiment, pluralities of electrostatic chucks 107 and temperature control means 313 are mounted on the table 420. The RF electrode 422 is made of a metal material, and electrically connected to the conductor formed on the lower surface of the substrate 401 (not shown). The RF electrode 422 is electrically insulated from the table 420 by the insulator 423, and is also DC-insulated from the matching box 425 by the capacitor 424.

Etching as one of substrate processing methods using the substrate processing apparatus shown in FIG. 4 according to the second aspect of the present invention will be described.

The gate 419 is opened, and the substrate 401 which has the above-mentioned film to be etched and patterned resist film on the first major surface and the conductor on the second major surface opposing the first major surface is set on the support 414. Then, the gate 419 is closed.

Each temperature control means 313 controls the temperature of the substrate 401 to a desired temperature with high uniformity by flowing cooling water through the cooling unit 312 of the temperature control means 313 and/or heating the substrate 401 by the heating unit 311 thereof.

The valve V3 is closed, and the main evacuation system 106 evacuates the interior of the vessel 402 to a desired atmosphere (e.g., pressure of $1\times10^{-4}$ Pa or less). Subsequently, the valve V3 is opened to introduce gas 2 into the grooves 109 of the electrostatic chucks 107, as described in the electron source/image display device manufacturing method. Further, a valve V2 is opened to introduce gas 3 as etching gas into the vessel 402 up to a desired pressure (e.g., pressure of 0.1 to 100 Pa). The attained pressure is maintained. Note that gas 2 may be the same gas species as gas 3.

The RF power supply 426 supplies RF power to the RF electrode 422 via the matching box 425 and capacitor 424. This generates the plasma 427 between the RF electrode 422, the substrate 401, and the inner wall surface of the vessel 402. The frequency of the RF power supply 426 is preferably 13.56 MHz, but is not particularly limited as far as the plasma 427 is generated.

The area of the inner wall surface of the electrically grounded vessel 402 is set much larger than the surface area of a total of the substrate 401 and vessel 402 in contact with the plasma 427. In addition, the mobilities of ions and electrons in the plasma 427 are different. For this reason, the surface of the substrate 401 and the RF electrode 422 are negatively DC-charged with respective to the vessel 402. By applying 0 V or a positive potential to the electrode 108 of the vacuum chuck 107 by the power supply 110, an electrostatic force acts between the lower surface of the substrate 401 and the electrode 108 at the same time as generation of the plasma 427, and the substrate 401 is electrostatically chucked to the electrostatic chuck 107. The surface of the substrate 401 is exposed to the generated plasma 427 for a desired time to etch the surface.

During etching, thermal energy is supplied from the plasma 427 to the substrate 401. In the substrate processing apparatus and method, the thermal energy generated by the plasma 427 is efficiently controlled by the temperature control means 313 via each electrostatic chuck 107. Since each electrostatic chuck 107 is independently controlled by a corresponding temperature control means 313, the surface of the substrate 401 is kept at a desired temperature with high uniformity.

The resist etching rate hardly varies depending on the location. Even in etching in which the selectivity cannot be ensured, the margin of the etching time can be increased, and appropriate etching can be executed. Since the surface temperature of the substrate 401 can be controlled to 100° C. or less with high uniformity, carbonization of the resist can be suppressed, and the subsequent ashing step can also be properly done.

In this embodiment, the temperature control means 313 and electrostatic chuck 107 preferably have the same thermal expansion coefficient. This is because a stress is generated inside the temperature control means 313 and electrostatic chuck 107 due to the difference in thermal expansion coefficient as the temperatures of the temperature control means 313 and electrostatic chuck 107 rise. When the temperature control means 313 is made of a metal or a metal-containing composite material, and the electrostatic chuck 107 is made of a ceramic, the allowable stress of the ceramic is small, so the electrostatic chuck 107 may be damaged. Note that the electrostatic chuck 107 was experimentally confirmed not to be damaged when the size of the electrostatic chuck 107 was almost 0.1 $m^2$ or less, and the difference in thermal expansion coefficient between the temperature control means 313 and the electrostatic chuck 107 was within 30%.

Figure 5:
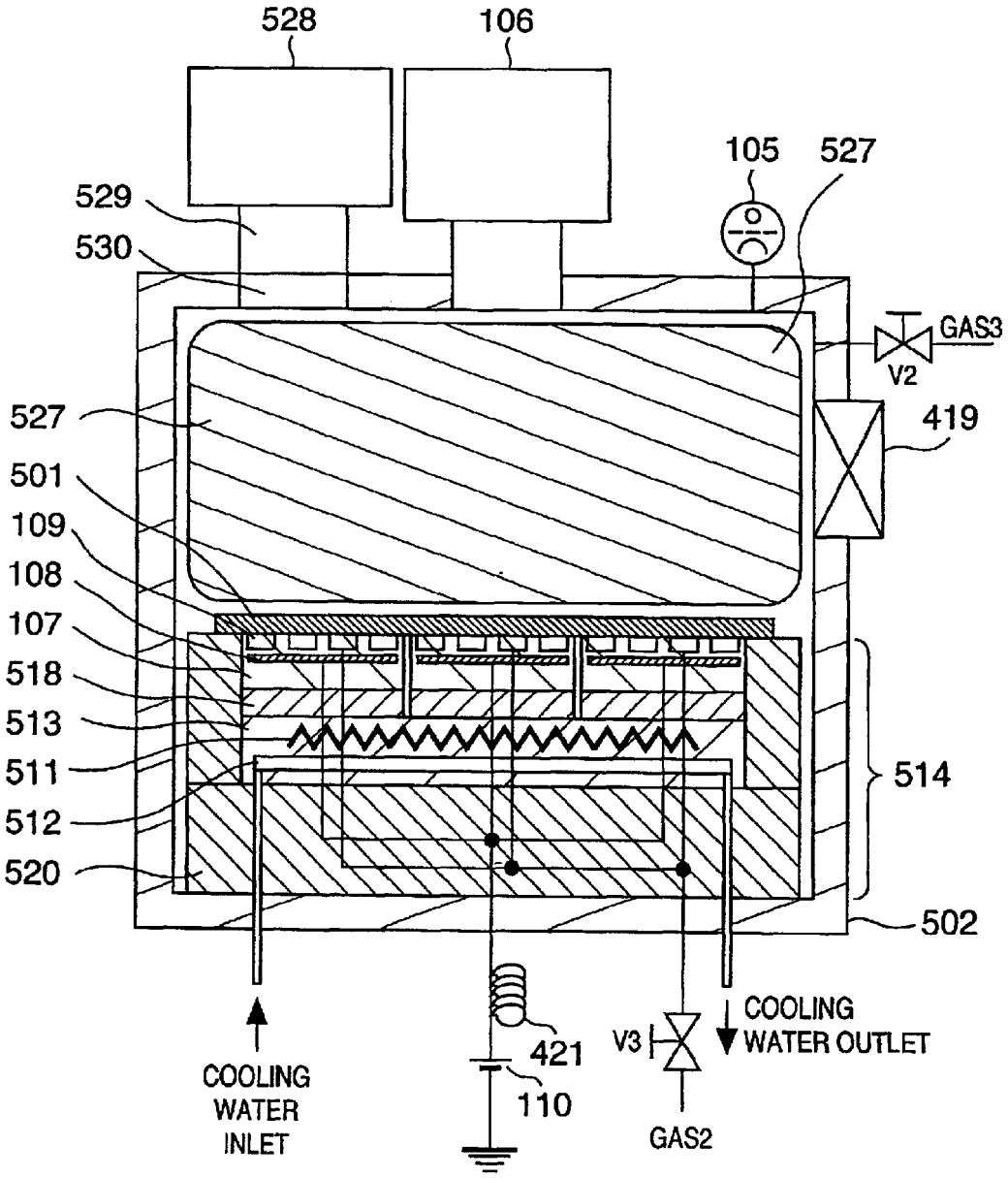
FIG. 5 is a block diagram showing a processing apparatus capable of executing microwave plasma processing according to the second aspect of the present invention.

FIG. 5 shows another example of the substrate processing apparatus and method according to the second aspect of the present invention. FIG. 5 is a block diagram showing the substrate processing apparatus. In FIG. 5, the same reference numerals as in FIGS. 1, 2, 3, and 4 denote the same parts.

In FIG. 5, reference numeral 501 denotes a substrate having first and second major surfaces. A conductor is arranged on the second major surface of the substrate 501. The conductor serves as an electrode for generating an electrostatic force between the substrate 501 and the electrode 108 of each electrostatic chuck 107. For this purpose, the conductor is preferably a film. Reference numeral 502 denotes a vessel; 511, a heating unit; 512, a cooling unit; and 513, a single temperature control means. In this embodiment, the temperature control means 513 has the heating unit 511 and cooling unit. The temperature control means described here need not always be comprised of a single temperature control means, as shown in FIG. 5, but may be constituted by a plurality of temperature control means, as shown in FIG. 4. When the temperature control means is constituted by a plurality of temperature control means, it is preferable that the temperature control means be equal in number to the electrostatic chucks 107, and one temperature control means and one electrostatic chuck constitute one unit. If one temperature control means is adopted for one electrostatic chuck, as described above, the temperature can be controlled with higher uniformity. Reference numerals 518 denote position adjusting mechanisms; 520, a table; 514, a support which comprises a plurality of electrostatic chuck 107, temperature control means 513, and table 520, and supports the substrate 501 inside the vessel 402; 527, a plasma; 528, a microwave generator; 530, a window for holding vacuum and transmitting microwaves; and 529, a waveguide for guiding microwaves generated by the microwave generator 528 to the microwave transmission window 530.

In the arrangement of FIG. 5, each position adjusting mechanism 518 is arranged for a corresponding electrostatic chuck 107 so as to keep a small interval between the substrate 501 and the surface of the electrostatic chuck 107. Microwaves generated by the microwave generator 528 pass through the microwave transmission window 530 via the waveguide 529, and enter the vessel 502 to generate a plasma. The frequency of the microwave is generally 2.45 GHz for industrial purpose, but is not limited to this. The microwave transmission window 530 can be made of silica glass, alumina, or the like, but the material is not limited as long as the microwave transmission window 530 can transmit microwaves without any loss.

One of basic processing methods using the substrate processing apparatus shown in FIG. 5 according to the second aspect of the present invention will be explained. Resist ashing as one of processing methods will be described.

The gate 419 is opened, and the etched substrate 501 is set on the support 514. The respective position adjusting mechanisms 518 are adjusted for each electrostatic chuck 107 so as to decrease the interval between the second major surface of the substrate 501 and the surface of the electrostatic chuck 107.

The temperature control means controls the temperature of the substrate 501 to a desired temperature with high uniformity by flowing cooling water through the cooling unit 512 and heating the substrate 501 by the heating unit 511.

The gate 419 and valve V3 are closed, and the main evacuation system 106 evacuates the interior of the vessel 502 to a desired pressure (e.g., pressure of $\times 10^{-3}$ Pa or less). At this time, the conductor on the second major surface of the substrate 501 is electrically grounded. A voltage of 100 V or more to 10 kV or less, preferably 500 V or more to 2 kV or less is applied between ground and the electrode (conductive member) 108. This generates an electrostatic force between the electrode (conductive member) 108 and the second major surface (conductor) of the substrate 501 to fix the substrate 501 to the support 514.

Then, the valve V3 is opened to introduce gas 2 to the grooves 109 of the electrostatic chucks 107, as shown in FIG. 4. Further, the valve V2 is opened to introduce gas 3 as ashing gas into the vessel 502 up to a desired pressure (e.g., pressure of 0.1 Pa or more to 200 Pa or less). The attained pressure is maintained. Gas 3 is preferably oxygen gas. Note that gas 2 may be the same gas species as gas 3.

Microwaves generated by the microwave generator 528 pass through the microwave transmission window 530 via the waveguide 529, and enter the vessel 502 to generate the plasma 527. The resist on the first major surface of the substrate 501 is ashed for a desired time by an active gas species and ions contained in the plasma 527.

During ashing, thermal energy generated by the plasma 527 is supplied to the substrate 501. According to this apparatus, the heat is efficiently controlled by the temperature control means 513 via each electrostatic chuck 107, and the surface of the substrate 501 is kept at a desired temperature with high uniformity. Therefore, the resist does not carbonize, the resist ashing rate does not vary depending on the location, and the overashing time can be shortened. A thin film with a desired pattern formed on the substrate 501 can be prevented from being damaged.

Also in the embodiment shown in FIG. 5, similar to the embodiment shown in FIG. 4, the temperature control means 513 and electrostatic chuck 107 preferably have the same thermal expansion coefficient. The preferable range of the thermal expansion coefficient is also the same as in the embodiment described with reference to FIG. 4.

Note that etching and ashing have been described with reference to FIGS. 4 and 5. The substrate processing apparatus and method according to the present invention can also be applied to another processing such as vapor deposition, sputtering, or CVD processing.

EXAMPLES

Examples of the present invention will be described.

Example 1

In Example 1, pairs of electrodes for a surface-conduction type electron-emitting device were arrayed on a substrate in order to fabricate an electron source in which many surface-conduction type electron-emitting devices were arrayed on the substrate. A method of performing etching using the processing apparatus shown in FIG. 4 in patterning the device electrodes will be explained.

Figure 6:
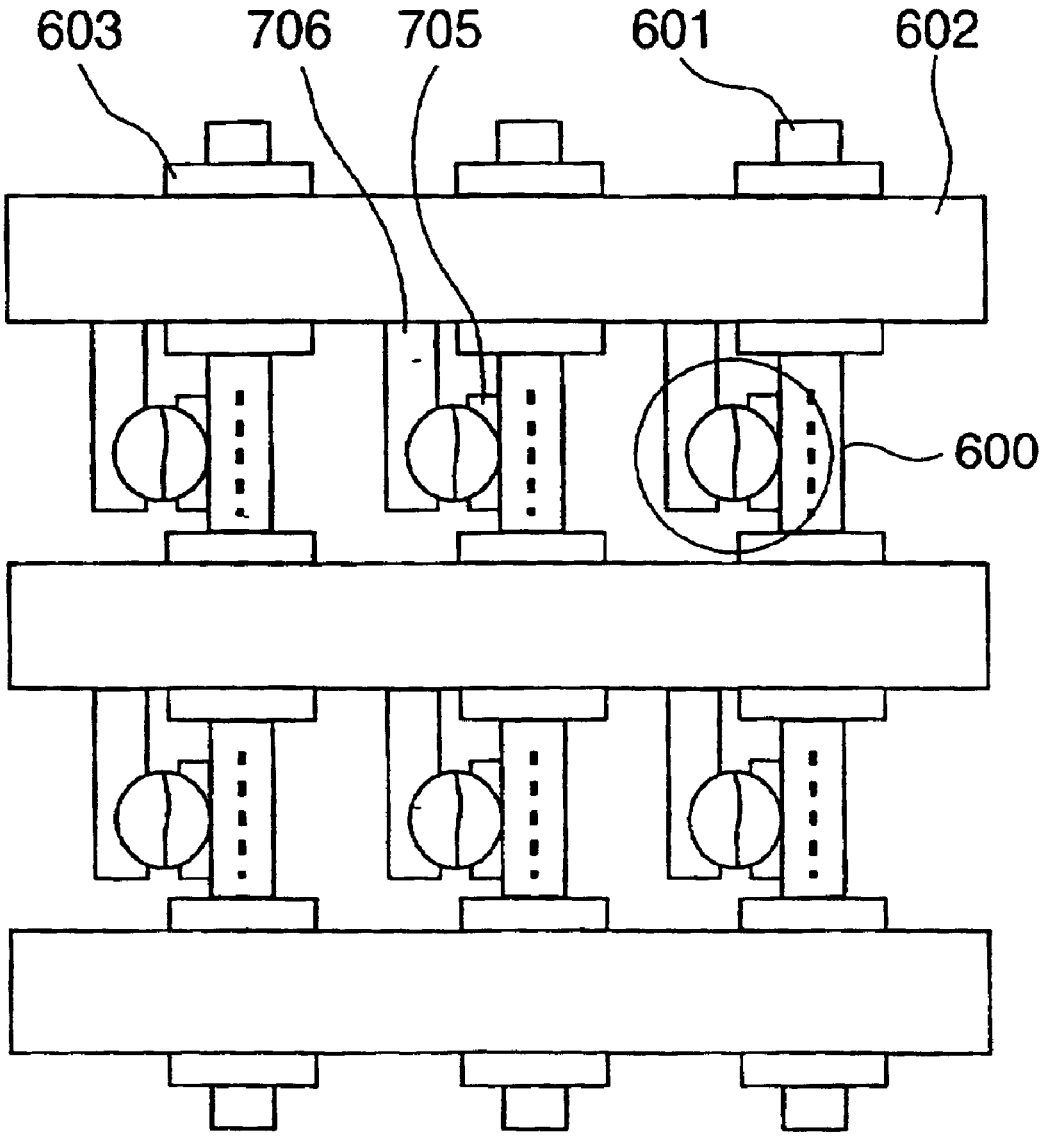
FIG. 6 is a schematic view showing an electron source and wire on a rear plate.
Figure 7A:
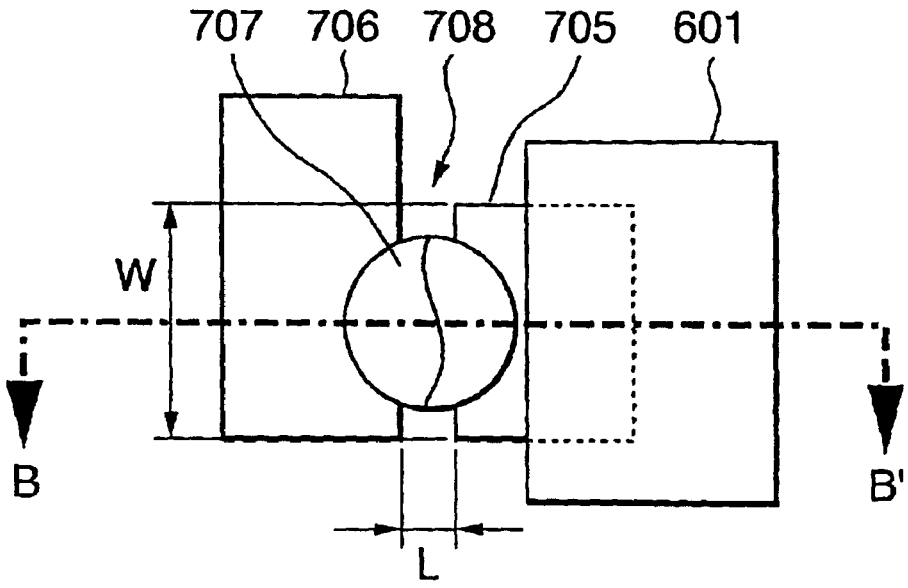
FIGS. 7A and 7B are an enlarged view and sectional view, respectively, showing the structure of a surface-conduction type electron-emitting device.
Figure 7B:
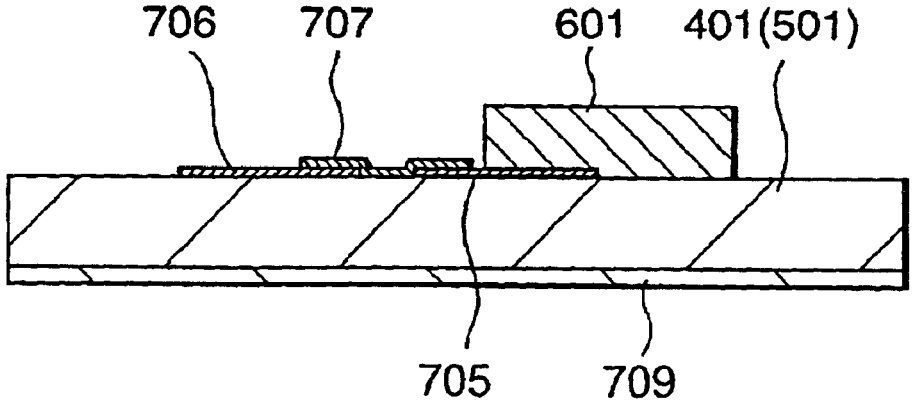
Figure 8:
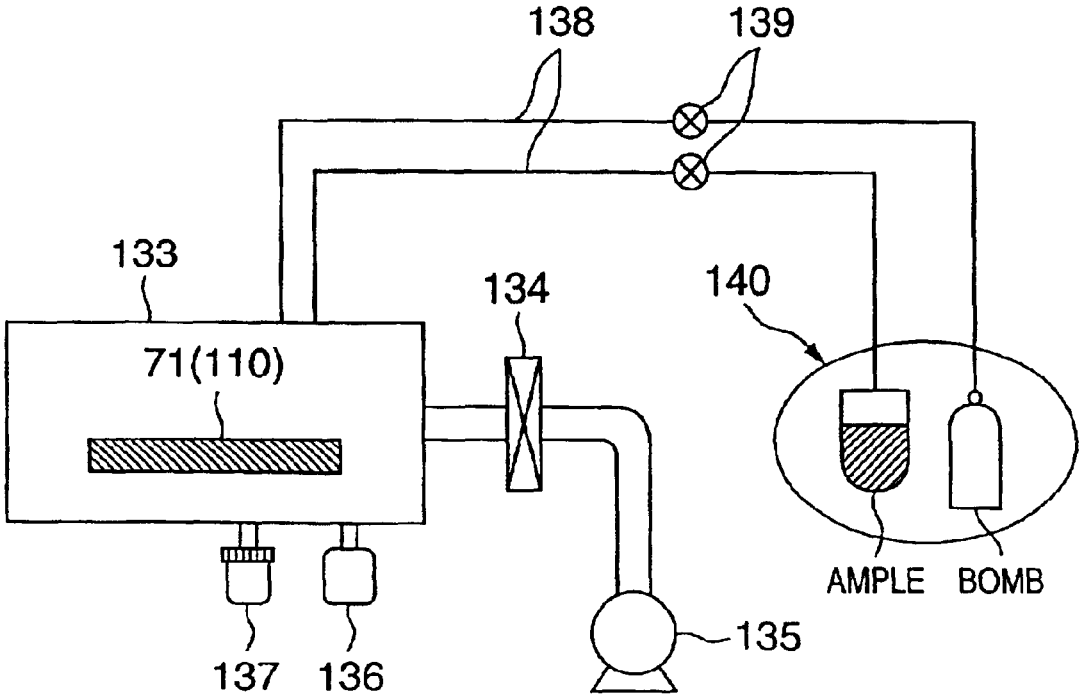
FIG. 8 is a schematic view showing a conventional image display device manufacturing apparatus.

A soda-lime glass substrate having a size of 850 mm×530 mm×2.8 mm (thickness) was used as a substrate 401. An 80-nm thick ITO film was formed on the entire lower surface (second surface) of the substrate 401 by electron beam deposition. This film was for an electrostatic chucking electrode. Surface-conduction type electron-emitting devices and wires shown in FIGS. 6, 7A, and 7B were finally formed on the surface (first surface) of the substrate 401. FIGS. 7A and 7B are showing the structure of a surface-conduction type electron-emitting device 600. In FIGS. 6, 7A, and 7B, reference numeral 600 denotes the surface-conduction type electron-emitting device; 601, a lower wire; 602, an upper wire; 603, an interlevel insulating film for electrically insulating the lower and upper wires 603 and 602; 705 and 706, device electrodes; 707, a conductive film; 708, an electron-emitting portion; and 709, a conductor. In FIGS. 6, 7A, and 7B, the same reference numerals as shown in FIGS. 1 to 5 denote the same parts. FIG. 7B is a sectional view taken along the line B–B' in FIG. 7A.

A 50-nm thick Pt film was formed for the device electrodes 705 and 706 on the surface (first surface) of the substrate 401 by electron beam deposition. A resist was applied on the Pt film, exposed by an exposure device, and developed to form 2,340×480 resist pairs having the same pattern as the pattern of the device electrodes 705 and 706 with W=0.2 mm and L=8 $\mu$m shown in FIG. 7A.

A gate valve 419 was opened, and the substrate 401 having the resist pattern was set on a support 414.

As electrostatic chucks 107, six alumina electrostatic chucks 107 in which silver-printed electrodes were buried as electrodes 108 with a size of 200 mm×300 mm×10 mm (thickness) were used, and fixed to corresponding temperature control means 313. Each temperature control means 313 was made of a copper-tungsten alloy, had a size of 200 m×300 mm×50 mm (thickness), and incorporated an 8-kW electric heater as a heating unit 311 and a water channel as a cooling unit 312.

The substrate 401 used in Example 1 warped in a concave shape by about 0.4 mm at the periphery compared to the center. To decrease the interval between each electrostatic chuck 107 and the substrate 401, each temperature control means 313 was fixed to a Ti table 420 having a size of 900 mm×600 mm×100 mm (thickness). An RF electrode 422 was made of Ti, and a stainless steel coil spring which was completely buried in contraction was buried in the surface of the RF electrode 422. Simultaneously when the substrate 401 was set on the support 414, the coil spring contracted or contacted the substrate 401, and the conductor 709 on the lower surface (second major surface) of the substrate 401 electrically contacted the RF electrode 422 of the table. An insulator 423 was made of alumina.

Each temperature control means held the temperature of the substrate 401 at 40° C. by flowing 15° C.-cooling water through the cooling unit 312 and heating the substrate 401 by the heating unit 311. After that, the gate valve 419 and valve V3 were closed, and a main evacuation system 106 evacuated the interior of a vessel 402 up to a pressure of $1\times10^{-4}$ Pa or less.

The valve V3 was opened, He gas was introduced as gas 2 into grooves 109 of the electrostatic chucks 107, and the internal pressure of the grooves 109 was maintained at 1,000 Pa. A valve V2 was opened, Ar gas serving as etching gas was introduced as gas 3 into the vessel 402, and the internal pressure of the vessel 402 was maintained at 2 Pa.

An RF power supply 426 supplied RF power of 13.56 MHz and 10 kW to the RF electrode 422 via a matching box 425 and capacitor 424, thereby generating a plasma 427 between the RF electrode 422, the substrate 401, and the inner wall surface of the vessel 402.

Immediately before the RF power supply 426 supplied the RF power, 500 V was applied to the electrode 108. With this application, an electrostatic force acted between the lower surface of the substrate 401 and the electrode 108, and the substrate 401 was electrostatically chucked by the electrostatic chuck 107. Chucking was confirmed from changes in He pressure. Etching was done 5 min after the plasma 427 was generated, and the pattern of the Pt device electrodes 705 and 706 was formed.

In Example 1, the cooling and heating units 312 and 311 could keep the surface temperature of the substrate 401 at 40° C. with high uniformity during etching, and the overetching time could be halved in comparison with conventional etching. The surface of the substrate 401 was hardly etched even after Pt was etched away, compared to conventional etching. In particular, the electron-emitting portion 708 was formed between the device electrodes 705 and 706, so the substrate surface below the electron-emitting portion 708 was hardly damaged. After these steps, the resist was removed. Lower wires 601, interlevel insulating films 603, and upper wires 602 were formed, and PdO conductive films were formed to connect the device electrodes 705 and 706. Subsequently, the conductive films underwent the above-described "forming" and "activation" steps to fabricate an electron source. The characteristics of the surface-conduction type electron-emitting devices 600, particularly the electron-emitting efficiency was improved in comparison with an electron source not according to this example. In addition, etching could be achieved without damaging the substrate 401.

Example 2

In Example 2, pairs of electrodes for a surface-conduction type electron-emitting device were arrayed on a substrate in order to fabricate an electron source in which many surface-conduction type electron-emitting devices were arrayed on the substrate. The structure of the electron source is the same as in Example 1, and a description thereof will be omitted.

In Example 2, a method of performing ashing using the processing apparatus shown in FIG. 5 in patterning the device electrodes will be described.

As electrostatic chucks 107, the processing apparatus shown in FIG. 5 employed six alumina electrostatic chucks 107 in which silver-printed electrodes were buried as electrodes 108 with a size of 200 mm×300 mm×10 mm (thickness). The electrostatic chucks 107 were mounted on independent position adjusting mechanisms 518 using a plurality of screws as a main mechanism, and the position adjusting mechanisms 518 were fixed to a single temperature control means 513. The temperature control means 513 was made of a copper-tungsten alloy, had a size of 900 m×600 mm×60 mm (thickness), and incorporated a 20-kW electric heater as a heating unit 511 and a water channel as a cooling unit 512. The temperature control means 513 was fixed on a Ti table having a size of 900 mm×600 mm×100 mm (thickness).

As the formation step of device electrodes 705 and 706, the first major surface of a substrate 501 underwent the steps (up to the etching step) before resist removal by photolithography. After the etching step, the substrate 501 warped in a concave shape by about 0.5 mm at the periphery compared to the center. A gate valve 419 was opened, and the substrate 501 was set on a support 514. The position adjusting mechanisms 518 were adjusted to decrease the interval between the electrostatic chucks 107 and the substrate 501. A stainless steel coil spring which was completely buried in contraction was buried in the upper surface of a table 520 that was in contact with the substrate 501. Simultaneously when the substrate 501 was set on the support 514, the coil spring contracted or contacted the substrate 501, and a conductor film 709 on the lower surface (second major surface) of the substrate 501 electrically contacted the table 520.

The temperature control means held the temperature of the substrate 501 at 60° C. by flowing 15° C.-cooling water through the cooling unit 512 and heating the substrate 501 by the heating unit 511. After that, the gate valve 419 and a valve V3 were closed, and a main evacuation system 106 evacuated the interior of a vessel 502 up to a pressure of $1\times10^{-4}$ Pa or less.

A power supply 110 applied 1.5 kV to the electrodes 108 via a filter 421 to electrostatically chuck the substrate 501 to the support 514 by the electrostatic chucks 107. The valve V3 was opened, oxygen gas was introduced as gas 2 into grooves 109 of the electrostatic chucks 107, and the internal pressure of the grooves 109 was maintained at 1,000 Pa. A valve V2 was opened, oxygen gas serving as ashing gas was introduced as gas 3 into the vessel 502, and the internal pressure of the vessel 502 was maintained at 10 Pa.

Microwaves of 10 kW generated by a microwave generator 528 entered the vessel 502 through a waveguide 529 and microwave transmission window 530, thereby generating a plasma 527. The substrate 501 was exposed to the plasma 527 for 4 min to ash the resist left on the patterned device electrodes 705 and 706.

During ashing, the temperature of the substrate surface could be kept at 60° C. with high uniformity, the resist did not carbonize, and the overashing time could be halved in comparison with conventional ashing. The substrate surface below an electron-emitting portion 708 between the device electrodes 705 and 706 was hardly damaged. After these steps, the resist was removed. Lower wires 601, interlevel insulating films 603, and upper wires 602 were formed, and PdO conductive films were formed to connect the device electrodes 705 and 706. Then, the conductive films were subjected to the above-described "forming" and "activation" steps to fabricate an electron source. The characteristics of surface-conduction type electron-emitting devices 600, particularly the electron-emitting efficiency were improved in comparison with an electron source not using to this example. Ashing could be done without damaging neither the substrate 501 nor electrostatic chucks 107.

Example 3

In Example 3, an electron source in which many surface-conduction type electron-emitting devices were arrayed on a substrate, and an image display device were fabricated using the manufacturing apparatus shown in FIG. 1. The structure of the electron source is the same as in Example 1, and a description thereof will be omitted.

As lower wires 601, 2,230 wires were formed by printing and baking (baking temperature: 550° C.) Ag paste ink by screen printing on a substrate 101 having pairs of device electrodes 705 and 706 formed by the method of Example 2. As insulating films 603, insulating-glass paste was printed and baked (baking temperature: 550° C.) on parts of the lower wire 601. As upper wires 602, 480 wires were formed by printing and baking (baking temperature: 550° C.) Ag paste ink. Note that the ends of the lower and upper wires 601 and 602 were formed up to 3 mm apart from the edge of the substrate 101 so as to connect the ends to a connection means (terminal) 116 outside a vessel 102 (in air).

A palladium complex solution was applied using a bubble-jet type of droplet ejection device so as to connect the device electrodes 705 and 706. The palladium complex solution was baked in air to form palladium oxide conductive films. In this way, the substrate 101 having a plurality of units each made up of a pair of electrodes and a conductive film before formation of an electron-emitting portion, and wires connected to the respective units was prepared. The substrate 101 was measured, and warped in a concave shape by about 0.5 mm at the periphery compared to the center.

As electrostatic chucks 107, the manufacturing apparatus shown in FIG. 1 employed six alumina electrostatic chucks 107 in which silver-printed electrodes were buried as electrodes 108 with a size of 200 mm×300 mm×10 mm (thickness). The electrostatic chucks 107 were fixed to a temperature control means 113 so as to decrease the interval between each electrostatic chuck 107 and the substrate 101. The temperature control means 113 was made of a copper-tungsten alloy, had a size of 900 m×600 mm×80 mm (thickness), and incorporated a 20-kW electric heater as a heating unit 111 and a water channel as a cooling unit 112. To electrically ground a conductor film 709 on the lower surface (second major surface) of the substrate 101, the apparatus comprised a mechanism of electrically grounding the conductor film 709 via a contact pin (not shown). As the connection means (terminal) 116, a probe unit made up of a plurality of probe pins was used.

In the manufacturing apparatus of FIG. 1, the vessel 102 was moved up, and the substrate 101 was set on a support 114. A valve V3 was closed, and a valve V4 was opened. A chucking exhaust system 115 evacuated the interior of each groove 109 to 100 Pa or less to chuck the substrate 101 to each electrostatic chuck 107. At that time, the lower surface (second major surface) of the substrate 101 was electrically grounded via the contact pin (not shown).

A power supply 110 applied a DC voltage of 1.2 kV between ground and each electrode 108, generating an electrostatic force. The substrate 101 was electrically chucked by the electrostatic chuck 107, and fixed to the support 114. The valve V4 was closed, and the valve V3 was opened. He gas was supplied as gas 2 to the groove 109, and the internal pressure of the groove 109 was maintained at 3,000 Pa. The vessel 102 was moved downward to contact the substrate 101 via an O-ring, and covered part of the first major surface of the substrate 101. Subsequently, a main evacuation system 106 evacuated the space defined by the vessel 102 and the first major surface of the substrate 101 to a pressure of $1\times10^{-4}$ Pa or less. The temperature control means 113 controlled the temperature of the substrate 101 and held the temperature at 50° C. with high uniformity by flowing 20° C.-cooling water through the cooling unit 112 and heating the substrate 101 by the heating unit 111.

After that, the "forming" step was performed.

The probe unit serving as the connection means (terminal) 116 was electrically connected to the ends of wires 601 and 602 exposed in air, and a signal generator (power supply) 117 applied a pulse voltage as a rectangular wave having a peak value of 11 V to each unit. A valve V2 was opened at the same time as application of the pulse voltage, and evacuation of the main evacuation system 106 was stopped. A gas mixture of nitrogen and hydrogen was introduced as gas 1 into the vessel 102. This step formed a gap in part of the conductive film forming each unit. At the same time, the conductive film was reduced from palladium oxide to palladium. Application of the pulse voltage was stopped, and the "forming" step ended. Heat generated by a current flowing through the wire in the "forming" step was efficiently controlled by the temperature control means via the electrostatic chuck 107. Accordingly, the substrate 101 was kept at a desired temperature with high uniformity, and appropriate "forming" could be done. The substrate 101 did not crack. The valve V2 was closed, and the evacuation system 106 evacuated the space defined by the vessel 102 and the first major surface of the substrate 101 to a pressure of $1\times10^{-4}$ Pa or less.

Then, the "activation" step was performed. In "activation", the temperature control means controlled the temperature of the substrate 101 to a constant temperature of 60° C. A valve V1 was opened to introduce tolunitrile as a carbon compound 104 into the vessel 102. The valve V1 was adjusted while an ionization vacuum gauge 105 measured the pressure so as to set the pressure to $2\times10^{-4}$ Pa. The signal generator (power supply) 117 applied a pulse voltage to the upper wires 602 simultaneously in units of 10 wires, and applied the voltage to the respective units. In the prior art, a carbon film deposited on the surface of a substrate 101 in the "activation" step varied owing to Joule heat generated by a current flowing through a wire. To the contrary, in the electron source of Example 3, a carbon film was uniformly deposited, resulting in highly uniform electron-emitting characteristics.

A plurality of spacers serving as atmospheric pressure-resistant structures were set on the upper wires 602 of the substrate 101 having the electron source in which many electron-emitting devices formed through the "forming" and "activation" steps were arrayed. The inner surface of a face plate was coated with a fluorescent substance (phospher), and connected to a glass exhaust pipe. The substrate 101 and face plate were temporarily fixed via frit glass and a support frame having getters mainly consisting of Ba so as to oppose each other. The resultant structure was baked in a heating furnace in an inert gas atmosphere at 420° C. to fabricate an airtight envelope.

The exhaust pipe was connected to an oil-free evacuation device. While the envelope was held at a temperature of 300° C., the interior of the envelope was evacuated. The exhaust pipe was chipped off by a burner or the like. The getters were flashed by RF heating to form a Ba film, thereby manufacturing an image display device.

Compared to the prior art, the image display device of Example 3 manufactured in this manner exhibited a small luminance distribution and could obtain a high-luminance display image for a long time.

Example 4

In Example 4, an electron source in which many surface-conduction type electron-emitting devices were arrayed on a substrate, and an image display device were fabricated using the manufacturing apparatus shown in FIG. 3. The structure of the electron source is the same as in Example 1, and a description thereof will be omitted.

Similar to Example 3, a substrate 101 up to the "forming" step was prepared. The substrate 101 was measured, and warped in a concave shape by about 0.5 mm at the periphery compared to the center, similar to Example 3.

As electrostatic chucks 107, the manufacturing apparatus shown in FIG. 3 employed six alumina electrostatic chucks 107 in which silver-printed electrodes were buried as electrodes (conductive members) 108 with a size of 200 mm×300 mm×10 mm (thickness). The electrostatic chucks 107 were respectively fixed to temperature control means 313. One temperature control means and one signal generator constituted one unit. Each temperature control means 313 was made of a copper-tungsten alloy, had a size of 200 m×300 mm×50 mm (thickness), and incorporated an 8-kW electric heater as a heating unit 311 and a water channel as a cooling unit 312.

To decrease the interval between each electrostatic chuck 107 and the substrate 101, each temperature control means 313 was fixed to a Ti table 320 having a size of 900 mm×600 mm×100 mm (thickness). To electrically ground a conductor film 709 on the lower surface (second major surface) of the substrate 101, the apparatus comprised a mechanism of electrically grounding the conductor film 709 via a contact pin (not shown). As a connection means (terminal) 316, the apparatus used a probe unit made up of a plurality of probe pins usable even in vacuum.

In the manufacturing apparatus of FIG. 3, a gate 319 was opened, and the substrate 101 was set on a support 314, and then the gate 319 was closed. A valve V3 was closed, and a valve V4 was opened. A chucking exhaust system 115 evacuated the interior of each groove 109 to 100 Pa or less to chuck the substrate 101 to each electrostatic chuck 107. At that time, the lower surface of the substrate 101 was electrically grounded via the contact pin (not shown). A power supply 110 applied a DC voltage of 1.5 kV between ground and each electrode (conductive member) 108, generating an electrostatic force. The substrate 101 was electrically chucked by the electrostatic chuck 107, and fixed to the support 114. The valve V4 was closed, and the valve V3 was opened. He gas was supplied as gas 2 to the groove 109, and the internal pressure of the groove 109 was maintained at 2,000 Pa. Each temperature control means 313 controlled the temperature of the substrate 101 to a constant temperature of 50° C. by flowing 20° C.-cooling water through the cooling unit 312 and heating the substrate 101 by the heating unit 311.

The probe unit as the connection means (terminal) 316 was brought into contact with the end of a wire connected to each unit arranged on the first major surface of the substrate 101. A main evacuation system 106 evacuated the interior of a vessel 302 to a pressure of $1\times10^{-4}$ Pa or less. Then, the "forming" step was performed. In the "forming" step, a signal generator (power supply) 117 applied a pulse voltage to each unit, thereby forming a gap in part of a conductive film forming each unit. In the "forming" step, a valve V2 was opened at the same time as application of the pulse, and evacuation of the main evacuation system 106 was stopped. A gas mixture of nitrogen and hydrogen was introduced as gas 1 into the vessel 302.

Heat generated by a current flowing through each wire in the "forming" step was efficiently controlled by the temperature control means 313 via the electrostatic chuck 107. Thus, the substrate 101 was kept at a desired temperature with high uniformity, and appropriate "forming" could be executed. The substrate 101 did not crack. Thereafter, the valve V2 was closed, and the evacuation system 106 evacuated the interior of the vessel 302 to a pressure of $1\times10^{-4}$ Pa or less.

The "activation" step was performed. The temperature control means controlled the temperature of the substrate 101 to a constant temperature of 60° C. A valve V1 was opened to introduce benzonitrile as a carbon compound 104 into the vessel 102. The valve V1 was adjusted while an ionization vacuum gauge 105 measured the pressure so as to set the pressure to $3\times10^{-4}$ Pa. The signal generator (power supply) 117 sequentially applied a bipolar pulse voltage to all the upper wires 602 simultaneously in units of 10 wires. This step formed an electron-emitting portion in each unit arranged on the first major surface of the substrate 101, and as a result, an electron source constituted by a plurality of electron-emitting devices was fabricated. Joule heat generated in the "forming" and "activation" steps was controlled on the first major surface of the substrate 101 by the temperature control means with high uniformity in the electron source fabricated in Example 4, compared to an electron source fabricated by a conventional method. Therefore, an electron source uniform in electron-emitting characteristics could be implemented.

Similar to Example 3, the subsequent image display device manufacturing process was executed to manufacture an image display device. This image display device could obtain a high-luminance display image with high uniformity for a long time.

As has been described above, the present invention can control heat generated in processing a substrate. In ashing, carbonization of a resist can be prevented. In etching, the margin of the etching time can be increased. Even for a larger-size substrate, damage to the substrate can be suppressed, and damage to an electrostatic chuck can also be prevented. Since the electrostatic chuck is comprised of a plurality of electrostatic chucks, they can be easily exchanged, which decreases the manufacturing cost.

In addition to these effects, a wire formed on a substrate can be easily, properly, stably connected to a connection means (e.g., probe) for connecting an external power supply in the "forming" and "activation" steps. Heat generated in the "forming" and "activation" steps can be controlled with high uniformity, so that electron-emitting devices with uniform electron-emitting characteristics can be formed in a large area.

Accordingly, the present invention can reduce defectives, can increase the yield, and can safely advance the process. The temperature distribution depending on the location can be decreased even on a larger-size substrate.

The present invention is not limited to the above embodiments and various changes and modifications can be made within the spirit and scope of the present invention. Therefore, to apprise the public of the scope of the present invention, the following claims are made.

What is claimed is:

1. An apparatus for manufacturing an electron source having a plurality of electron-emitting devices, comprising:

(A) a support for supporting a substrate having a first major surface and a second major surface on which a conductor is arranged, said support including a plurality of fixing means each having a conductive member, and the first major surface having a plurality of units each formed from a pair of electrodes and a conductive film interposed between the electrodes, and wires connected to the units;

(B) a vessel which has a gas inlet port and an exhaust port, and covers part of the first major surface;

(C) a gas controller for at least one of introducing gas into said vessel and exhausting gas from said vessel; and (D) a power supply for applying a predetermined potential difference between the conductor on the second major surface and the conductive members of said plurality of fixing means.

2. The apparatus according to claim 1, wherein said support further comprises a temperature controller.

3. The apparatus according to claim 2, wherein said temperature controller includes a plurality of temperature controllers.

4. The apparatus according to claim 3, wherein each of said plurality of temperature controllers is connected to a corresponding one of said plurality of fixing means.

5. The apparatus according to claim 1, wherein each fixing means has a surface in contact with the second major surface, and the surface has a concave portion.

6. The apparatus according to claim 1, wherein each fixing means has an insulating surface, and incorporates the conductive member.

7. The apparatus according to claim 1, further comprising a voltage applier for applying a voltage to the wires on the first major surface.

8. An apparatus for manufacturing an electron source having a plurality of electron-emitting devices, comprising:

(A) a vessel which has a pressure-reducible space, a gas inlet port for introducing gas into the space, and an exhaust port for exhausting the gas from the space;

(B) a support for supporting a substrate having a first major surface and a second major surface on which a conductor is arranged, said support including a temperature controller and a plurality of fixing means each having a conductive member, and said support being arranged in the space;

(C) a gas controller for at least one of introducing gas into said vessel and exhausting gas from said vessel; and (D) a power supply for applying a predetermined potential difference between the conductor on the second major surface and the conductive members of said plurality of fixing means.

9. The apparatus according to claim 8, wherein said temperature controller includes a plurality of temperature controllers.

10. The apparatus according to claim 9, wherein each of said plurality of temperature controllers is connected to a corresponding one of said plurality of fixing means.

11. The apparatus according to claim 8, wherein each fixing means has a surface in contact with the second major surface, and the surface has a concave portion.

12. The apparatus according to claim 8, wherein each fixing means has an insulating surface, and incorporates the conductive member.

13. A method of manufacturing an electron source having a plurality of electron-emitting devices, comprising the steps of:

(A) preparing a substrate having a first major surface and a second major surface opposing the first major surface, the first major surface having a plurality of units each formed from a pair of electrodes and a conductive film interposed between the electrodes, and wires connected to the units; and the second major surface having a conductor;

(B) preparing a support, the support including a plurality of fixing means each having a conductive member;

(C) fixing the substrate to the support by applying a potential difference between the conductive member and the conductor;

(D) arranging the plurality of units in a space defined by the first major surface of the substrate and a vessel by covering part of the first major surface of the substrate with the vessel, part of the wires being arranged outside the space;

(E) setting a desired atmosphere in the space; and (F) applying a voltage to the plurality of units via part of the wires outside the space.

14. The method according to claim 13, wherein the step of setting the desired atmosphere in the space comprises the step of evacuating an interior of the space.

15. The method according to claim 13, wherein the step of setting the desired atmosphere in the space comprises the step of introducing gas into the space.

16. The method according to claim 13, wherein the step of fixing the substrate to the support comprises the step of vacuum-chucking the substrate and the support.

17. A method of manufacturing an image display device having an electron source and a fluorescent substance, comprising the steps of:

(A) preparing a substrate having a first major surface and a second major surface opposing the first major surface, the first major surface having a plurality of units each formed from a pair of electrodes and a conductive film interposed between the electrodes, and wires connected to the units; and the second major surface having a conductor;

(B) preparing a support, the support including a plurality of fixing means each having a conductive member;

(C) fixing the substrate to the support by applying a potential difference between the conductive member and the conductor;

(D) arranging the plurality of units in a space defined by the first major surface of the substrate and a vessel by covering part of the first major surface of the substrate with the vessel, part of the wires being arranged outside the space;

(E) setting a desired atmosphere in the space;

(F) applying a voltage to the plurality of units via part of the wires outside the space;

(G) preparing a second substrate having a fluorescent substance; and (H) arranging the second substrate and the substrate having on the first major surface the plurality of units to which the voltage is applied, so as to oppose each other via a second space.

18. The method according to claim 17, wherein the step of setting the desired atmosphere in the space comprises the step of evacuating an interior of the space.

19. The method according to claim 17, wherein the step of setting the desired atmosphere in the space comprises the step of introducing gas into the space.

20. The method according to claim 17, wherein the step of fixing the substrate to the support comprises the step of vacuum-chucking the substrate and the support.

21. A method of manufacturing an electron source having a plurality of electron-emitting devices, comprising the steps of:

(A) preparing a vessel which has a pressure-reducible space, a gas inlet port for introducing gas into the space, and an exhaust port for exhausting the gas from the space;

(B) preparing a support in the space, the support including a temperature control means and a plurality of fixing means each having a conductive member;

(C) preparing a substrate having a first major surface and a second major surface opposing the first major surface, the first major surface having a plurality of units each formed from a pair of electrodes and a conductive film interposed between the electrodes, and wires connected to the units, and the second major surface having a conductor;

(D) loading the substrate into the space;

(E) fixing the substrate to the support in the space by applying a potential difference between the conductive member and the conductor; and (F) setting a desired atmosphere in the space, and applying a voltage to the plurality of units via the wires while controlling a temperature of the substrate by the temperature control means.

22. The method according to claim 21, wherein the step of setting the desired atmosphere in the space comprises the step of evacuating an interior of the space.

23. The method according to claim 21, wherein the step of setting the desired atmosphere in the space comprises the step of introducing gas into the space.

24. The method according to claim 21, wherein the step of fixing the substrate to the support comprises the step of vacuum-chucking the substrate and the support.

25. A method of manufacturing an image display device, comprising the steps of:

(A) preparing a vessel which has a pressure-reducible space, a gas inlet port for introducing gas into the space, and an exhaust port for exhausting the gas from the space;

(B) preparing a support in the space, the support including temperature control means and a plurality of fixing means each having a conductive member;

(C) preparing a substrate having a first major surface and a second major surface opposing the first major surface, the first major surface having a plurality of units each formed from a pair of electrodes and a conductive film interposed between the electrodes, and wires connected to the units, and the second major surface having a conductor;

(D) loading the substrate into the space;

(E) fixing the substrate to the support in the space by applying a potential difference between the conductive member and the conductor;

(F) setting a desired atmosphere in the space, and applying a voltage to the plurality of units via the wires while controlling a temperature of the substrate by the temperature control means;

(G) preparing a second substrate having a fluorescent substance; and (H) arranging the second substrate and the substrate having on the first major surface the plurality of units to which the voltage is applied, so as to oppose each other via a space.

26. The method according to claim 25, wherein the step of setting the desired atmosphere in the space comprises the step of evacuating an interior of the space.

27. The method according to claim 25, wherein the step of setting the desired atmosphere in the space comprises the step of introducing gas into the space.

28. The method according to claim 25, wherein the step of fixing the substrate to the support comprises the step of vacuum-chucking the substrate and the support.

29. A substrate processing method comprising the steps of:

(A) preparing a support including a plurality of fixing means each having a conductive member and temperature control means;

(B) preparing a substrate having a conductor;

(C) fixing the substrate to the support by applying a potential difference between the conductive member and the conductor; and (D) performing predetermined processing for a surface of the substrate while controlling a temperature of the substrate by the temperature control means.

* * * * *

UNITED STATES PATENT AND TRADEMARK OFFICE

CERTIFICATE OF CORRECTION

PATENT NO. : 6,846,213 B2
DATED : January 25, 2005
INVENTOR(S) : Yasue Sato

It is certified that error appears in the above-identified patent and that said Letters Patent is hereby corrected as shown below:

Title page,
Item [56], References Cited, FOREIGN PATENT DOCUMENTS,
"JP 57/161241" should read -- JP 57-161241 --.
"JP 10/206876 A" should read -- JP 10-206876 A --.
"JP 08064119 A" should read -- JP 08-64119 A --.
"JP 09/330653" should read -- JP 09-330653 --.

Column 2
Line 27, "an," should read -- a --.

Column 5
Line 40, "large area" should read -- large-area --.

Column 7
Line 24, "Pdo." should read -- PdO. --.

Column 11
Line 14, "(phospher)," should read -- (phosphor), --.

Column 15,
Line 25, "chuck" should read -- chucks --.

Column 19
Line 34, "neither" should read -- either --.
Line 35, "nor" should read -- or --.

UNITED STATES PATENT AND TRADEMARK OFFICE

CERTIFICATE OF CORRECTION

PATENT NO. : 6,846,213 B2
DATED : January 25, 2005
INVENTOR(S) : Yasue Sato

It is certified that error appears in the above-identified patent and that said Letters Patent is hereby corrected as shown below:

Column 21
Line 20, "(phospher)," should read -- (phosphor), --.

Signed and Sealed this

Twelfth Day of July, 2005

JON W. DUDAS
*Director of the United States Patent and Trademark Office*